US007789114B2

(12) United States Patent
Pace et al.

(10) Patent No.: US 7,789,114 B2
(45) Date of Patent: Sep. 7, 2010

(54) INTERCHANGEABLE HANDBAG CARRY SYSTEM

(75) Inventors: Susan Pace, West Islip, NY (US); Laurie McFadden, West Islip, NY (US)

(73) Assignee: I O Bag Inc., West Islip, NY (US)

( * ) Notice: Subject to any disclaimer, the term of this patent is extended or adjusted under 35 U.S.C. 154(b) by 441 days.

(21) Appl. No.: 11/637,436

(22) Filed: Dec. 12, 2006

(65) Prior Publication Data

US 2007/0163689 A1 Jul. 19, 2007

Related U.S. Application Data

(63) Continuation-in-part of application No. 11/331,560, filed on Jan. 14, 2006, now Pat. No. 7,607,461, and a continuation-in-part of application No. 10/869,542, filed on Jun. 15, 2004, now Pat. No. 7,028,730.

(51) Int. Cl.
*A45C 3/08* (2006.01)

(52) U.S. Cl. ..... 150/105; 150/103; 150/104; 150/113; 190/26; 383/111

(58) Field of Classification Search ..... 150/103–106, 150/112, 113; 190/26, 110; 383/111
See application file for complete search history.

(56) References Cited

U.S. PATENT DOCUMENTS 1,960,396 A * 5/1934 Rosenberg ..... 150/105
1,978,971 A 10/1934 Thornhill
2,023,144 A 12/1935 Miller
2,053,464 A * 9/1936 Dalsheim ..... 150/105
2,118,400 A * 5/1938 Goldberg ..... 150/105
2,131,382 A 9/1938 Lobel
2,355,155 A * 8/1944 Greenfield ..... 150/104
2,432,365 A 12/1947 Allen
2,437,382 A 9/1948 Czap
D155,811 S 11/1949 Kigere
2,653,640 A * 9/1953 Browning ..... 150/105
2,779,373 A 1/1957 Koepke
2,798,524 A 7/1957 Ryon (Continued)

OTHER PUBLICATIONS

Lenora Raye,Unique Interchangeable Handbags,lenoraraye.com, 13 pages,2004.

(Continued)

*Primary Examiner*—Sue A Weaver
(74) *Attorney, Agent, or Firm*—Tutunjian & Bitetto, P.C.

(57) ABSTRACT

An interchangeable handbag system includes a stand alone foundation handbag having an inner storage accommodating surface and an outer decorative surface. The foundation handbag may have regions, such as a hollow interior, front panel, a rear panel and a bottom panel connected by at least one edge to form a hollow container open at a top end thereof. Alternately the foundation handbag may be a simple flexible open-top container with a closed bottom, where the hollow interior, front and rear regions are part of the continuous container. The handbag system includes one or more reversible and/or non-reversible outer slip covers that fit over the foundation bag in a nested arrangement. The slip covers may fit over all and/or alternately a portion of the foundation bag and/or another slip cover. The slip covers and foundation bag are connected by one and/or multiple fastening structures.

9 Claims, 20 Drawing Sheets

U.S. PATENT DOCUMENTS

| | | | | | |
|---|---|---|---|---|---|
| 2,809,685 | A | | 10/1957 | Lowy | |
| 2,845,974 | A | | 8/1958 | Arden | |
| 3,182,701 | A | | 5/1965 | Ginsburg | |
| 3,234,985 | A | | 2/1966 | Gilbert | |
| 3,536,116 | A | | 10/1970 | Margolis | |
| 3,934,749 | A | | 1/1976 | Andrulionis | |
| 4,027,710 | A | | 6/1977 | Keebler | |
| 4,112,991 | A | * | 9/1978 | Barbaresi | 150/104 |
| 4,263,951 | A | | 4/1981 | Siegel | |
| 4,716,947 | A | | 1/1988 | Haddock | |
| 4,754,790 | A | | 7/1988 | Meyers | |
| 4,907,633 | A | | 3/1990 | Eckstein | |
| 5,029,344 | A | | 7/1991 | Shannon | |
| 5,207,254 | A | | 5/1993 | Fromm | |
| D339,683 | S | | 9/1993 | Zavitz | |
| 5,503,204 | A | | 4/1996 | Byers | |
| 5,533,558 | A | | 7/1996 | Carey | |
| 5,628,093 | A | * | 5/1997 | Goodale | 24/381 |
| 5,725,039 | A | | 3/1998 | Marcinai | |
| 5,894,975 | A | * | 4/1999 | Holden et al. | 224/582 |
| 6,003,573 | A | * | 12/1999 | Owens | 150/104 |
| 6,029,723 | A | | 2/2000 | Baquero | |
| 6,047,404 | A | * | 4/2000 | Blanks | 2/69 |
| 6,129,126 | A | * | 10/2000 | Restivo | 150/105 |
| 6,173,837 | B1 | | 1/2001 | Marconi | |
| 6,179,025 | B1 | | 1/2001 | Sutton | |
| 6,186,201 | B1 | | 2/2001 | Salz | |
| 6,382,376 | B1 | | 5/2002 | Rosen | |
| 6,394,157 | B2 | | 5/2002 | Luna | |
| 6,422,278 | B1 | | 7/2002 | Grogan | |
| 6,543,499 | B2 | | 4/2003 | McCreery | |
| 6,807,992 | B2 | | 10/2004 | Powers | |
| 6,820,664 | B1 | * | 11/2004 | Ritch | 150/103 |
| 6,971,424 | B1 | | 12/2005 | Angevine | |
| 7,028,730 | B2 | * | 4/2006 | Pace et al. | 150/105 |
| 7,222,649 | B1 | | 5/2007 | Fox | |
| 7,461,676 | B2 | | 12/2008 | Huie | |
| 2001/0015248 | A1 | * | 8/2001 | McCreery | 150/104 |
| 2003/0177664 | A1 | | 9/2003 | Manassebain | |
| 2007/0209742 | A1 | | 9/2007 | Morgan | |
| 2008/0006355 | A1 | | 1/2008 | Gomez | |
| 2008/0185082 | A1 | | 8/2008 | Mejia | |
| 2008/0230158 | A1 | | 9/2008 | Romero | |
| 2009/0065110 | A1 | | 3/2009 | Cassella | |
| 2009/0188592 | A1 | | 7/2009 | Connacher | |

OTHER PUBLICATIONS

Romag Fasteners are Engineered for Excellence, Ease and Customer Satisfaction, www.romag.com, 2004.

* cited by examiner

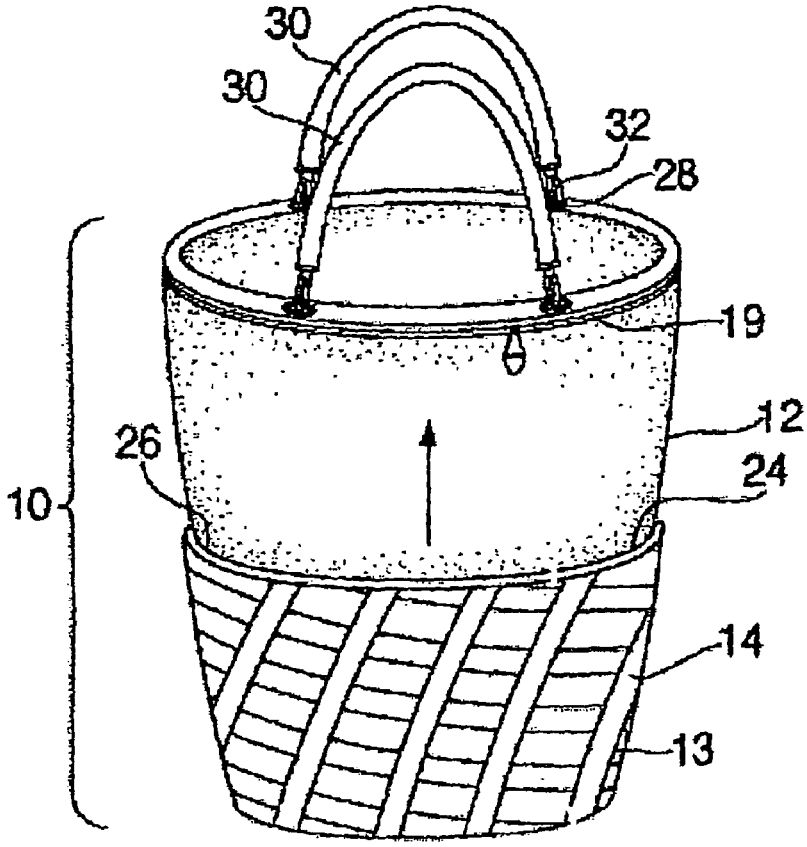
FIG. 1A
FIG. 3C
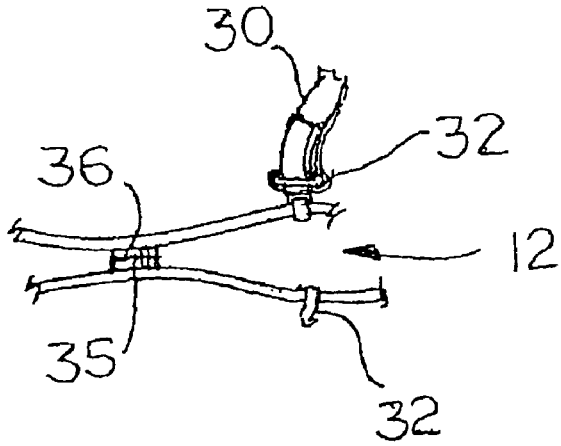

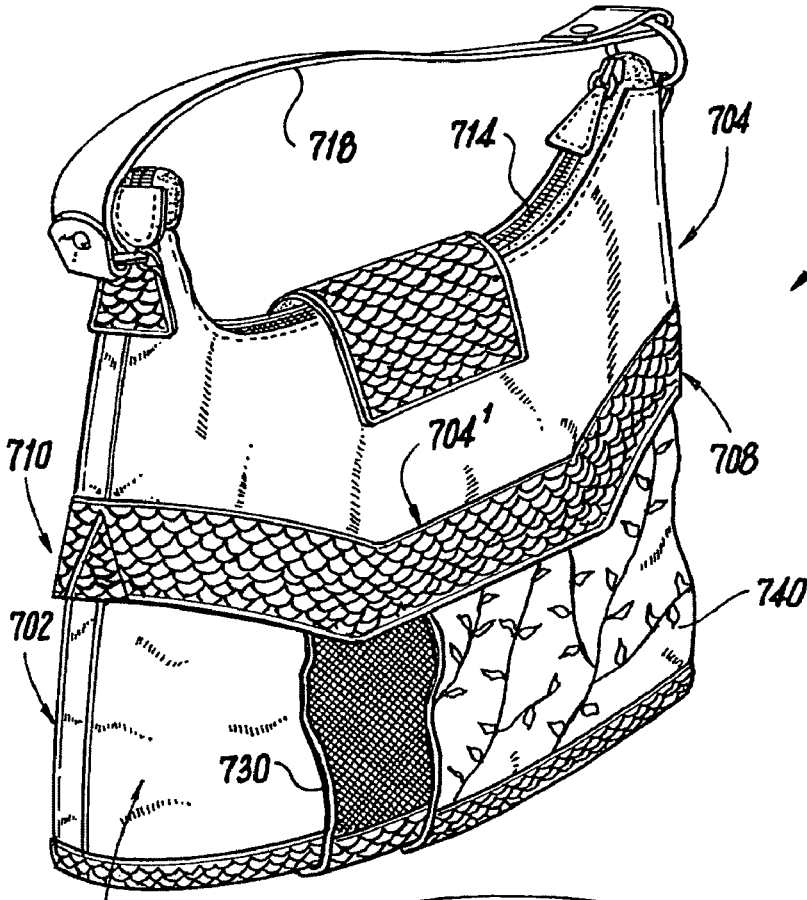
Fig. 9A
Fig. 9B
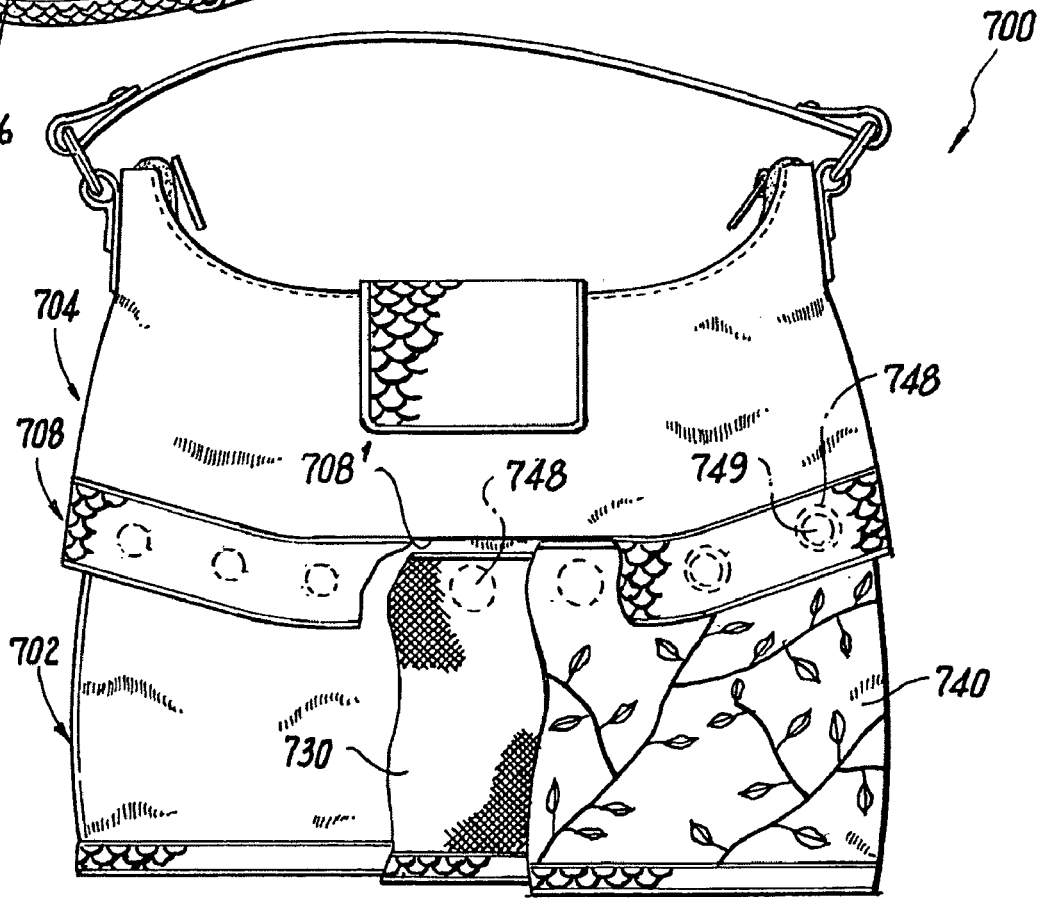

INTERCHANGEABLE HANDBAG CARRY SYSTEM

RELATED APPLICATION INFORMATION

This application is a continuation-in-part of U.S. patent application Ser. No. 11/331,560, filed Jan. 14, 2006, now issued as U.S. Pat. No. 7,607,461, and of U.S. patent application Ser. No. 10/869,542, filed Jun. 15, 2004, now issued as U.S. Pat. No. 7,028,730.

BACKGROUND OF THE INVENTION

1. Field of the Invention

Embodiments of the present invention generally relate to handbags and handbag systems. More particularly, the invention relates to a handbag, handbag system and method for using the handbag or handbag system that has one or more interchangeable outer slipcovers. In addition, each of the outer slipcovers, lining and handbag straps can optionally be reversible and/or stackable with each other. The inside of the handbag can also have an optional lining which is removable and reversible and which contains compartments for the storage and safety of various personal items.

2. Description of the Related Art

The roles of women have changed dramatically over the past few decades. The modern woman today is fitness and health conscious; career and goal oriented; a dedicated mother, wife and friend; a homemaker; an individual who travels extensively for work and recreation; or a woman whose role encompasses one or more of the aforementioned. In addition, throughout history, women have also been known to be extremely fashion and accessory conscious. Not only do they purchase clothing to support the roles they have attained in life but have purchased and changed their handbags to enhance each outfit or event.

Women also play multiple roles in any given day (e.g., a morning at the gym, a day at the office, a lunch with friends or colleagues, a late afternoon at the soccer field and an evening out to dinner). Women purchase a multitude of handbags in every color, texture and pattern to match the clothing they wear for each of these events resulting in many problems. For example, one obvious problem is the cost of purchasing so many handbags. In addition, changing handbags daily or multiple times per day to meet the needs of women is not only time consuming but often results in leaving an essential item such as a cell-phone, house key or store return receipt in the prior bag when switched. Other commonly related handbag problems include the inability to clean soil from the handbag's lining and exterior; the handbag that is otherwise good but must be discarded because the bottom is scraped, worn or torn; when traveling, not being able to utilize precious luggage space for clothes because multiple handbags are packed in their place to match the day, evening and casual attire necessary for the trip.

In prior years, various attempts have been made to solve some of these problems but the cited prior patents have not come close to solving them all. The present invention solves them all and more.

For example, known prior art includes "Lenora Raye" handbags with interchangeable handbag covers, as noted in the website lenoraraye.com where an inner liner of a handbag has a zipper near a top peripheral edge thereof. The zipper mates with a corresponding zipper located at a top peripheral edge of an interchangeable handbag cover, which can be unzipped and replaced by another handbag cover of a different design. However, the Lenora Raye outer bag covers teach only interchangeable outer bag covers, not one or more reversible covers or, optionally, multiple reversible covers which are plurally stackable within each other.

Additionally Lenora Raye handbags of this design are not based on a fully functional handbag with optional attached covers; instead, a cover must be attached to the inner liner to complete the Lenora Raye handbag. These handbags also do not appear to have reversible straps or liners.

Known patents include U.S. Pat. No. 6,543,499 of McCreery and U.S. Pat. No. 6,186,201 of Salz for interchangeable carrying bag systems, which include a respective inner foundation bag insertable within a respective outer cover of the same shape as the inner foundation bag. However, in McCreery '499 and Salz '201, the inner bag has an annular band of VELCRO® hook and loop fasteners, which mates with an outer annular band of VELCRO® hook and loop fasteners, or linear segments thereof; on a corresponding outer upper edge of the inner foundation bag. The disadvantage is that when the inner foundation bag is used by itself, the outer annular ring of VELCRO® hook and loop fasteners must be covered with a secondary annular fabric ring, or else the wearer's wrist and arm will be irritated by being exposed to and rubbing against the exposed VELCRO® hook and loop fasteners, not zippers. Hence, the outer side surfaces of McCreery's and Salz's inner foundation bags are encumbered by either exposed VELCRO® hook and loop fasteners, or by an annular decorative fabric ring covering the VELCRO® hook and loop fasteners.

U.S. Pat. No. 1,978,971 of Thornhill describes a hand bag and handbag cover which includes an inner bag insertable within an outer cover bag. The inner and outer bags are connected by buttons and button slots, which can be construed as "fasteners."

U.S. Pat. No. 3,234,985 of Gilbert also describes a handbag with changeable covers. In Gilbert '985, the outer cover is attached at a top edge to the inside foundation bag. However, the fastener in Gilbert '985 comprises a linearly extending resilient insert, which is inserted within a linearly extending channel extending along a top edge of the inner bag.

In addition, U.S. Pat. No. 5,628,093 of Goodale and U.S. Pat. No. 6,047,404 of Blanks both describe dual post zippers which include posts at both ends of a zipper tape. These dual post zippers are described for the application of mattress covers and reversible clothing. Thus there is still a need for a handbag which addresses the problems discussed above.

U.S. Pat. No. 2,053,464 of Dalsheim discloses a reversible vertically oriented sash which is discontinuous, i.e. having a gap spatially separating its two ends from each other. Additionally, Dalsheim '464 does not continuously cover the entire circumference of the foundation bag in a horizontal side to side plane.

SUMMARY OF THE INVENTION

The present invention generally includes a pocketbook, handbag or purse, but is not limited to and can include a diaper bag, backpack, tote, beach bag, fanny pack, briefcase and or any other carry bag.

In various embodiments, the carrying bag system includes a fully functional foundation bag preferably having a removable inner liner which is optionally reversible. The inner liner features several compartments for storage of personal items such as wallet, cell phone, keys, tissues, etc. and the inner liner can also be turned inside out to view different configurations of compartments depending on the users wants and needs. For specialized bags, such as diaper bags, the component compartments can be oriented toward the bag's use, with compartments for wipes, diapers, change of clothes, etc. This allows for more versatility. Embodiments of the invention can also preferably include interchangeable straps which can be reversible or removed to change the look and function of the handbag; and double sided reversible slipcovers which can be interchangeable with other double sided reversible slipcovers. An optional embodiment of the invention allows other slipcovers to be stacked within each other, so that a plurality of slipcovers may be nested between the foundation bag and the outermost slipcover. Thus, the other slipcovers are held by the connection between the foundation bag and the outermost slipcover.

The outermost slipcovers are attached by either a conventional single post zipper or a dual post zipper. A conventional zipper, with one engagement post at its proximal end and a stop at its opposite distal end, is used on non-reversible slipcovers. However, a dual post zipper is always used on the top peripheral edge of reversible slipcovers, to facilitate proper engagement with the mating zipper slide and pull portion attached to the outer surface of the foundation bag. In this manner, a properly facing engagement zipper post is available to mate with the foundation bag regardless of the outer surface or orientation of the outer slipcover selected. A different separating-type zipper is used to attach the removable liner to the inside of the foundation bag. The zipper can be located along the upper, middle or lower regions of the foundation bag or a combination of one or more of these regions. The zipper mates with, and is fed into, a slide and pull portion of a corresponding zipper extended along various outside surfaces of the foundation bag. As a result, the outermost slipcover is suspended from the annular peripheral edge extending along the outside surface of the inner foundation bag. The zipper attaching the slipcover to the foundation bag can be optionally covered by a flap.

The position of the zipper on the foundation bag can vary, depending upon how much, if any, of the foundation bag is to be exposed above the outer slipcover. For example, if the zipper is at the top periphery of the foundation bag, then its outer surface will be completely hidden by the slipcover.

On the other hand, if the outer slipcover is shorter than the foundation bag, then a portion of the foundation bag will be exposed above the top periphery of the outer slipcover. In that case, the zipper on the foundation bag is located lower than at the top periphery of the foundation bag and mates with the zipper at the top periphery of the outer slipcover, exposing a portion of the foundation bag to view.

Additionally, each outer slipcover is also optionally reversible with a different design pattern, material, color, texture and/or embellishment on either side of the outer slipcover so that when turned inside out, the outer surface design is changed to meet the user's needs in order to change the look and function of the handbag.

In other embodiments of this invention, the apparent line of demarcation between the fully functional foundation bag and the slip cover may not be a horizontal line as viewed from the side, front and back. For example, in one embodiment, a trapezoidal outer flap, which is permanently attached at one end to the foundation bag, defines the interface between these two sections, namely, the common boundary region between the foundation bag and the slip cover. Other outer flap geometric configurations may be applicable in addition to trapezoids, such as arcs, squares, zigzags, rectangles, waves, polygons or portions thereof. In one embodiment, a horizontal zipper slide and pull half portion hidden under the outer trapezoidal flap joins the slip cover with the foundation bag. The foundation bag zipper slide and pull half portion is attached to a horizontal inner skirt connected to the foundation handbag underneath the trapezoidal or other geometrically shaped outer flap. The purpose of the inner skirt is to permit smooth operation of the zipper slide and pull half portion attached to the lower peripheral edge of the inner skirt, as it engages with a reciprocating zipper post half portion, attached to a top edge or top region of an outer slip cover. The horizontally placed zipper, which, when placed along a contoured edge of an outer flap with a non-horizontal shape, will normally not glide smoothly. The inner skirt also permits the attachment of a horizontal zipper to the foundation bag without being stitched to the outer flap, thus concealing the zipper stitching on the foundation bag wall, thereby enabling more room for stacking outer slip covers or more embellished, thicker ones like slip covers with fringe, fur, quilting and/or pockets. In other embodiments of this outer trapezoidal flap foundation bag, the slip covers are attached by fastener means other than a zipper. For example, arrays of user operable fasteners may be employed in place of a zipper, such as snaps, magnetic snaps, magnets, French snaps, mechanical traditional snaps, sewn-in snaps and non-sewn in snaps, buttons, collar buttons, studs, screw-in studs, press in studs, sewn in standard buttons, buckles, turn locks, single turn locks, double turn locks, triple plate turn locks, flap turn locks, drop turn locks, swivel snaps, catches, flap push button catches, flap spring catches, tuck catches and tuck locks, snap hooks, grommets, D rings, and O rings, connected grommets, D rings and O rings, linear zippers. linear dual post zippers, curved zippers, curved dual post zippers, toggles, clips, spring clips, or swivel clips.

These attachment mechanisms include optionally discrete manually applied spot fasteners, with single or multiple attachment positions, such as, for example, snaps, buttons, buckles, turn locks, swivel snaps, catches, tucks, clips, toggles and snap hooks or others known to those skilled in the art of handbag manufacturing. Each of these attachment devices can be further defined in sub-categories, for example snaps can be magnetic, mechanical, or French types. The attachment devices may be concealed, such as the magnetic fasteners by, for example, being sewn in beneath a finished surface. Alternate means of concealing magnetic fasteners are also possible with the present invention, such as fixing them in a concealed location by gluing or the creation of a snug pocket or by any other means know to those skilled in the art.

The fastening devices may not be concealed. Such fastening devices as traditional snaps or buttons or turn-locks can not be concealed if they are to be functional, but such non-concealed fasteners can be attached by being sewn in, glued, and punch pressed and by any other means conventionally known to those skilled in the art.

If the demarcation between the foundation bag and the slip cover is of a curved nature with no sharp corners, a curved zipper, such as in U.S. Pat. No. 6,244,484 of Farrell, can optionally be used for attachment. These can be single post on the slip cover if it is not reversible, or dual post for reversible curved slip covers. The zipper follows the curve of the interface edge between the foundation bag and the outer slip cover. The curved zipper can be outwardly visible, or it can be covered by an outer flap of any geometric configuration or attached to an inner skirt.

In a further embodiment, the outer slip cover is attached to an inner surface located inside the foundation bag adjacent to its top edge; this is facilitated by flaps attached to the top open edge of the outer slip cover in which the flaps are folded over the foundation bag edge engaging its inner surface.

The inner skirt can be located anywhere on the outside of the foundation bag, underneath and concealed by the outer flap. Thus, the inner skirt does not necessarily require a deep outer flap. An alternate embodiment of the present invention can have a shallow outer flap rather than a deep one.

Furthermore, it is noted that the one or more outer slip covers are designed to circumferentially and continuously cover at least a portion, if not all, of the foundation bag, unlike Dalsheim '464.

BRIEF DESCRIPTION OF THE DRAWINGS

So that the manner in which the above recited features of the present invention can be understood in detail, a more particular description of the invention, briefly summarized above, may be had by reference to the embodiments, some of which are illustrated in the appended drawings. It is to be noted, however, that the appended drawings illustrate only typical embodiments of this invention and are therefore not to be considered limiting of scope; for the invention may admit to other equally effective embodiments. For example, the interchangeable carrying bag system of the present invention may include a foundation handbag having an inner storage compartment and an outer surface; wherein the foundation handbag has an interior, front, rear and bottom regions connected by at least one edge to form a container open at a top end thereof; and wherein said handbag system has at least one reversible slip cover. The at least one slip cover has an interior, front, bottom regions connected by at least one edge to form a container open at a top end thereof. A continuous inner surface of the at least one slip cover continuously covers at least a continuous portion of the continuous outer surface of the foundation handbag. The foundation handbag and the at least one reversible slip cover have a common connection interface therebetween.

FIG. 1A is a perspective view of the carry bag as in FIG. 1, showing sliding assembly of the decorative outer cover over the inner foundation bag, wherein the arrow indicates the sliding direction of the slipcover over the foundation bag.

FIG. 3C is a close up detailed top plan view of a portion of the foundation bag of FIG. 3, shown closed by a pair of fasteners.

FIG. 8EE is a close up detail view of the tote handbag system as in FIG. 8A showing a concealed zipper portion of a dual post zipper attachment on the underside of the foundation bag outer flap, which is raised to expose the connection interface of a reciprocating zipper portion of the dual post zipper attachment to the outermost cover.

FIG. 9A is a perspective view of a handbag system showing a foundation bag and multiple outer stackable slip covers, wherein the foundation bag has a trapezoidal shaped outer flap covering one or more trapezoidal or non linear geometrically shaped regions of slip covers, wherein the foundation bag's trapezoidal outer flap joinery edge is attached on the upper mid region half of the wall of the foundation bag.

FIG. 9B is a front elevational view of the handbag system as in FIG. 9A, but where in cutaway the non-linear interface connection includes a plurality of discrete user operable fasteners.

FIG. 13A is a front perspective view in partial cutaway of a handbag system and FIG. 13B is an exploded view of the handbag system of FIG. 13A, showing another embodiment of the handbag system with a foundation bag and one or more outer slip covers having foldover flaps, wherein the depicted outer slip cover is connected to the foundation bag by both multiple discrete magnetic fasteners located along the inside of the foundation bag and the inside of the outer slip cover; and also connected by an interchangeable handle fastened through the foundation bag via a swivel snap hook. It is understood that other fastener means can be used on the handle, such as a buckle, toggle, spring clip and other fasteners known to those in the manufacturing of handbags.

To facilitate understanding, identical reference numerals have been used, wherever possible, to designate identical elements that are common to the figures.

DETAILED DESCRIPTION OF THE PREFERRED EMBODIMENT

So that the manner in which the above recited features of the invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

Figure 1:
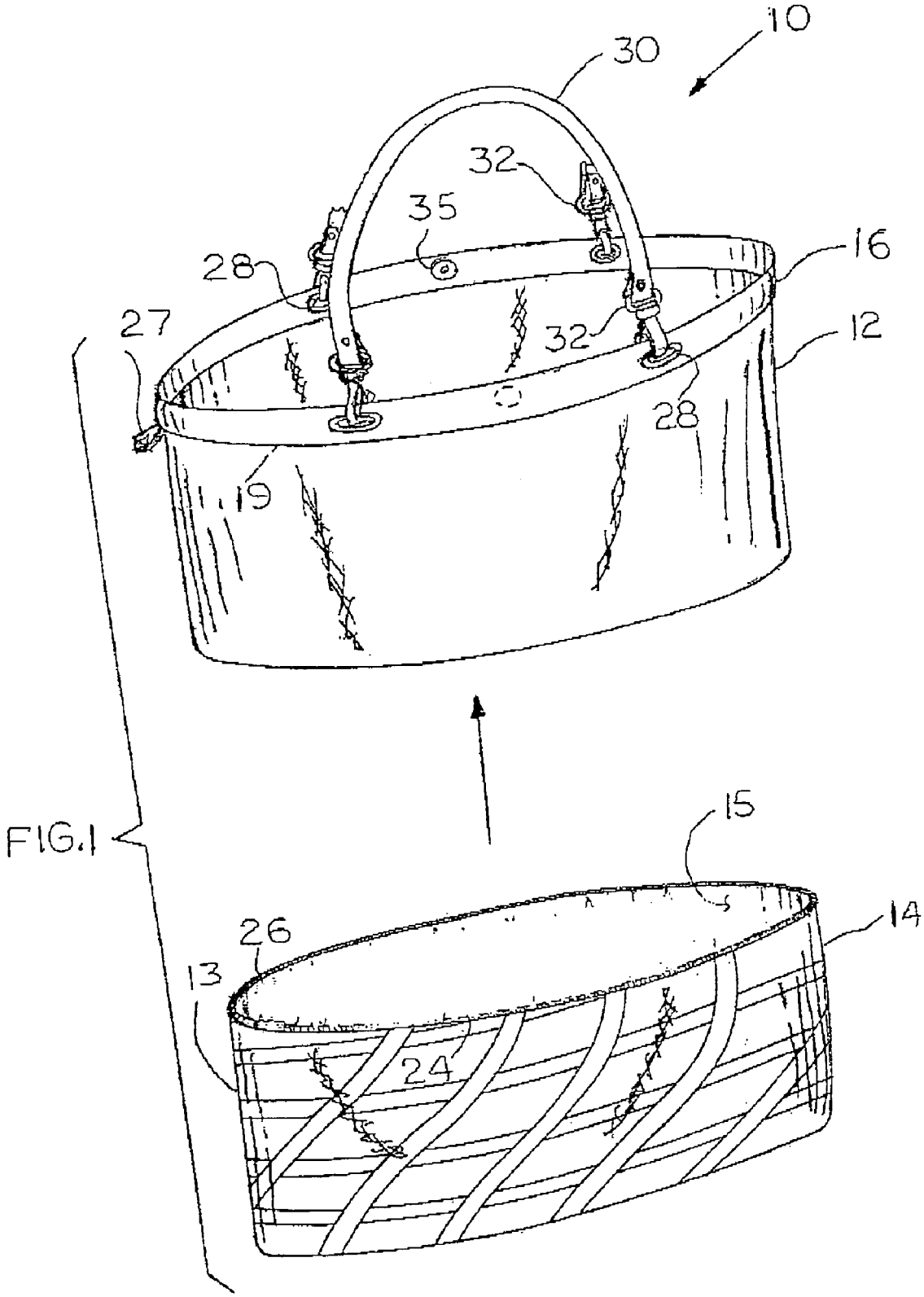
FIG. 1 is a perspective view of an embodiment of an interchangeable carry bag system, showing one handle in perspective and a cutaway view of the connecting end of a further handle wherein the arrow indicates the sliding direction of the slipcover over the foundation bag.

Specifically, FIG. 1 depicts an interchangeable carry bag system (10). The system (10) includes a discrete foundation bag 12 and a non-reversible sleeve-like outer slipcover 13. The outer slipcover 13 has a first outer surface 14 and a second inner surface 15. The first outer surface 14 is illustratively a decorative surface and can be made of material including but not limited to leather, suede, cotton, silk, etc. and can have a variety of decorative textures, patterns and embellishments. The second inner surface 15 is a lining of the outer slipcover 13 made of various materials including but not limited to cotton, polyester or other natural or manmade materials. The outer slipcover 13 contains a first fastening structure 24 which is located circumferentially along the top periphery of the outer slipcover 13. The first fastening zipper structure 24 is one side of a standard zipper containing a single post 26. A user may slip the outer slipcover 13 over the foundation bag 12 and position the post 26 from the first fastening zipper structure 24 of the slipcover 13 into the slide and pull portion of the second fastening zipper structure 19 of the foundation bag 12, in order to interlock the outer slipcover 13 to the foundation bag 12 and create a different look for the handbag system 10. The process of zipping the outer slipcover 13 on and off is easy, simple and quick and is a preferred method of fastening the outer slipcover 13 to the foundation bag 12. Zipper slide and pull portion 19, located on an outer surface of foundation bag 12, is operated via zipper handle clasp pull tab 27. FIG. 1 also shows optional flap 16 covering and hiding zipper portion 19 thereunder. Flap 16 extends from and is connected to foundation bag 12 at one side and has an opposite distal outer free floating edge.

In addition, FIG. 1 also depicts an optional handle 30. Illustratively, handle 30 is shown as a reversible handle, but it is known that non-reversible handles, such as handle 23 of FIG. 2C, may also be used, as well as no handle, in a clutch bag configuration. The handle 30 is coupled to the foundation bag 12 via connectors which may be oriented in different directions, such as, for example, swiveled loops 32 on the ends of the handles 30 which are looped through grommets 28 near the top periphery of the foundation bag 12. The swiveled loops 32 allow a user to rotate the handle 30 so that the opposing (i.e., previously unseen) side of the handle is now viewable to further alter the look of the foundation bag 12.

Figure 2:
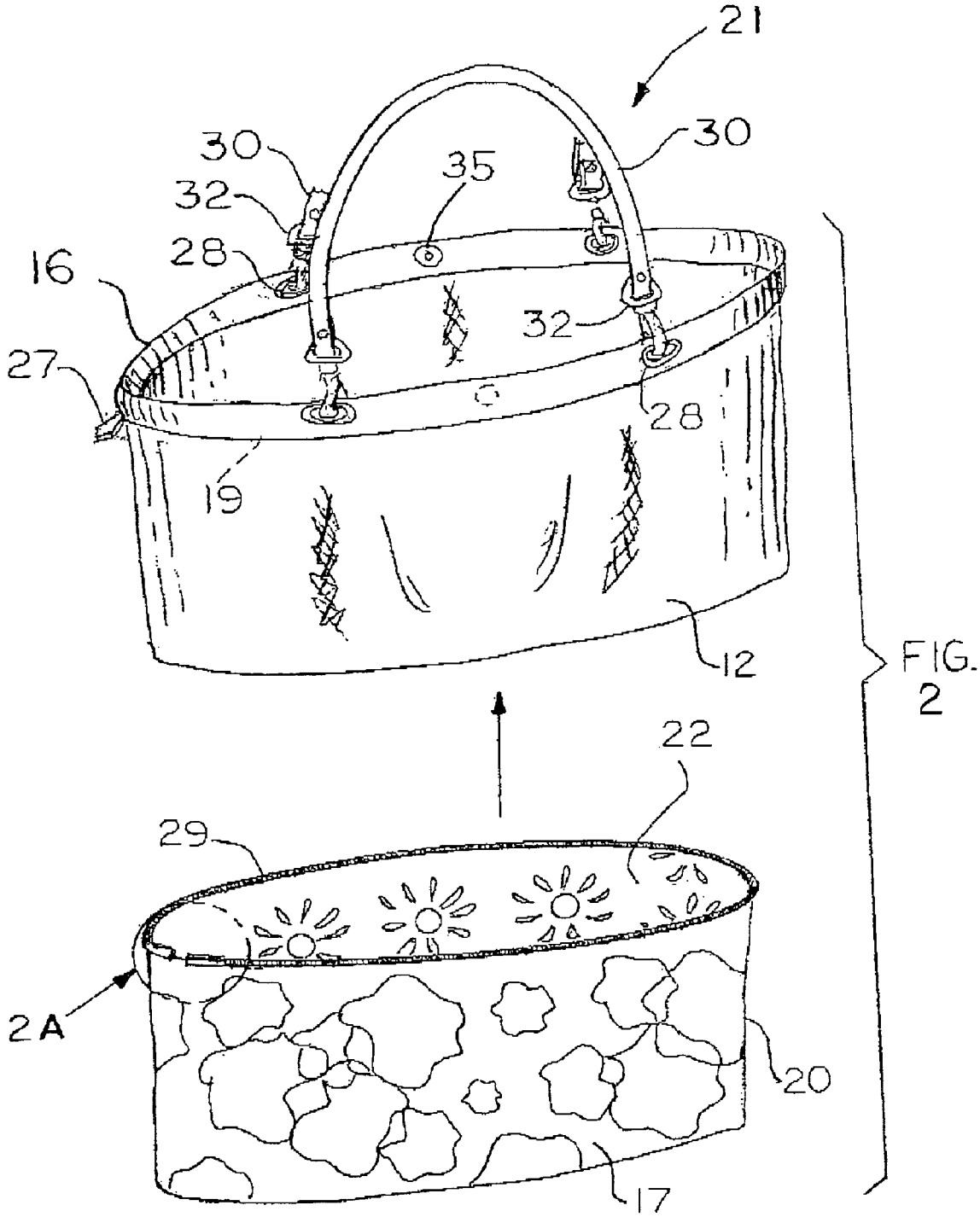
FIG. 2 is a perspective view of an embodiment of an interchangeable carry bag system showing a foundation bag and an outer slipcover which is reversible, showing one handle in perspective and a cutaway view of the connecting end of a further handle wherein the arrow indicates the sliding direction of the slipcover over the foundation bag.
Figure 2A:
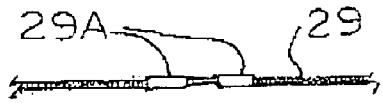
FIG. 2A is a close-up perspective view of a portion of the dual post zipper shown in FIG. 2, taken along the dashed line ellipse "2A" of FIG. 2.
Figure 2B:
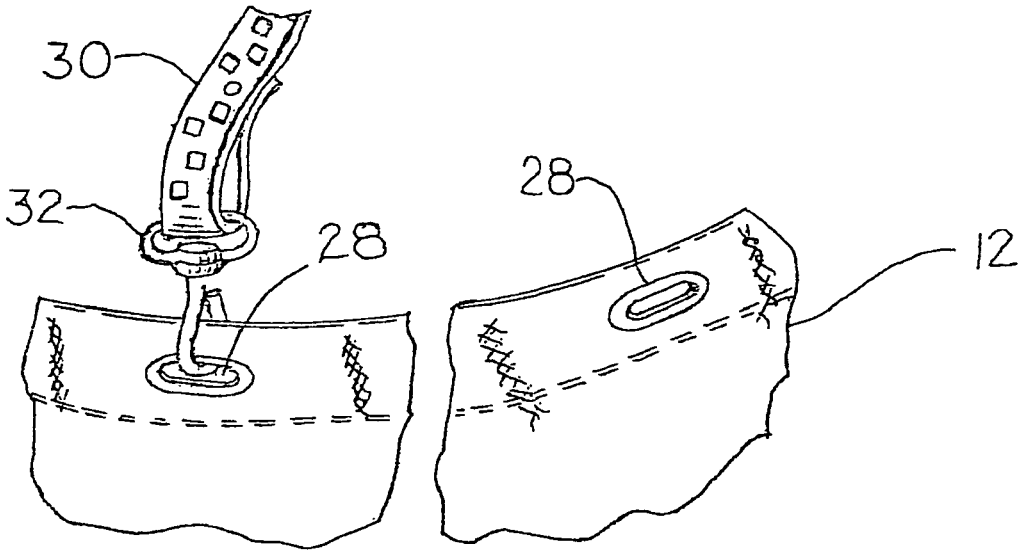
FIG. 2B is a close-up perspective view of connectors for optionally interchangeable reversible handles.
Figure 2D:
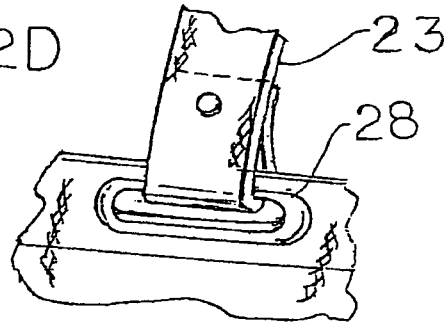
FIG. 2D is a close-up perspective view of an optional permanently attached handle joint for non-reversible straps taken along the dashed line ellipse "2D" of FIG. 2C.
Figure 2C:
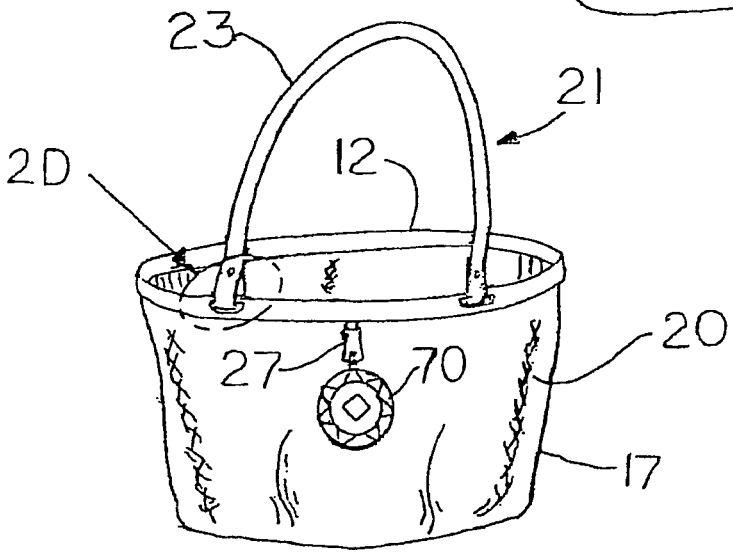
FIG. 2C is a perspective view of an alternate embodiment for a handbag system having a decorative pendant suspended from the zipper handle clasp, and showing a further embodiment for a permanently attached handle.

Although FIG. 1 depicts the handbag system 10 using handles 30 it is appreciated that the invention may be practiced without the use of handles 30 or with non reversible sewn-in or otherwise permanently attached handles 23 shown in FIG. 2C. Further, other embodiments of this invention can include other types of handles, fastening structures and other shapes, sizes and embellishments of the foundation bag 12 and outer slipcovers 13.

FIG. 1A is a perspective view of the handbag system 10 as described above and depicted in FIG. 1. Specifically, FIG. 1A shows non-reversible outer slipcover 13 partially slipped over foundation bag 12. A portion of the foundation bag 12 is lifted to show the zipper slide and pull portion 19 of foundation bag 12 ready for interlocking with the single post zipper portion 24 of outer slipcover 13. The elements in FIG. 1A have been already described with respect to FIG. 1. For brevity, a description of those elements is not repeated.

FIG. 2 is a perspective view of another embodiment of an interchangeable carry bag system 21. Specifically, FIG. 2 depicts a handbag system 21 having a foundation bag 12 and an outer slipcover 17 which is reversible. Many of the elements of the handbag system 21 depicted in FIG. 2 have been previously depicted and described with respect the handbag system depicted in FIG. 1. As such, and for the purpose of brevity, a description of those elements is not repeated.

The reversible sleeve-like outer slipcover 17 has a first decorative outer surface 20 and a second decorative inner surface 22. The outer surface 20 and inner surface 22 are both decorative surfaces made from a wide variety of materials. Each surface (20 and 22) has its own distinctive decorative color, pattern, texture and/or embellishments. The outer reversible slipcover 17 also contains a dual post fastening zipper structure 29 which is located circumferentially along the top periphery of the outer reversible slipcover 17. The dual post fastening structure is one side of a zipper. The zipper post portion 29 contains axially oriented dual posts 29*a* at opposite ends thereof, which are also shown in a close-up detail view in FIG. 2A. The user may turn the outer reversible slipcover 17 inside out to reveal the second surface 22. The user may slip the outer reversible slipcover 17 over the foundation bag 12 and position one post 29*a* from the dual post fastening structure 29 of the outer reversible slipcover 17 into the slide and pull portion of the second fastening structure 19 of the foundation bag 12, in order to interlock the outer reversible slipcover 17 to the foundation bag 12 and create another different look. The reversible slipcover 17 of FIG. 2 offers more options to the user than the nonreversible slipcover 13 of FIG. 1. Thus, when utilizing the interchangeable carry bag system according to this embodiment, the user can obtain four different appearances for the handbag system by using the foundation bag 12 by itself, without an outer slipcover; using the foundation bag 12 with the non-reversible outer slipcover 13; or using the foundation bag 12 with reversible outer slipcover 17 in either orientation, with either its outer side or inner side exposed. It is appreciated that other embodiments of the invention can include other types of fastening structures and other shapes, sizes and embellishments of foundation bags and slipcovers. FIG. 2 also shows closure member 35 to close the top of foundation bag 12 with closure member 36 of FIG. 3C. FIG. 2 also shows optional flap 16 covering and hiding zipper portion 19 thereunder. Flap 16 extends from and is connected to foundation bag 12 at one side and has an opposite distal outer free floating edge.

FIG. 2A is a close-up perspective view of a portion of the dual post zipper portion 29 shown in FIG. 2. Specifically, FIG. 2A depicts a first side portion 29 of a zipper which interlocks with a mating second slide and pull portion 19 of the zipper, located under the optional flap shown in FIG. 2, on an outer surface of the foundation bag 12. The first side of the zipper post portion 29 has dual posts 29*a* located at each end of the first side of the zipper 29. The dual post 29*a* allows a user to interlock the first and second portions (29 and 19) of the zipper regardless of the outer or inner side (20 and 22) of the outer slipcover 17 being exposed outwardly.

FIG. 2B is a close-up perspective view of optionally interchangeable reversible handles 30. The handles 30 shown in FIG. 2 operate as described above with respect to FIGS. 1 and 3.

FIG. 2C is a perspective view of an alternate embodiment for a carry bag system 21 having an optional decorative pendant 70 suspended from a zipper handle pull clasp 27. As opposed to the normal engaged (zipped) position of zipper handle pull clasp 27 shown in FIGS. 1-3 at the left side of foundation bag 12, if a decorative pendant 70 is used, this zipped position of pull clasp 27 on zipper side portion 19 is relocated to the outer side center of foundation bag 12, as shown in FIG. 2C. Preferably, to maintain the pendant 70 in the center of foundation bag 12, zipper slide and pull portion 19 would require a post, to stop the zipper slide and pull portion 19 at the center of foundation bag 12. It is appreciated that the decorative pendant 70 can be made from any type of material, be of any color, and any shape; and be used in accordance with the invention. Furthermore, it is noted that the zipper post 26 or 29*a* can be located anywhere along the outer side surface of foundation bag 12, so that the zipper handle pull clasp 27 can be conveniently positioned to allow for minimal pulling effort and torque to slide the handle clasp 27 along zipper portions 19 and 29 of the reversible bag or 19 and 24 of the non-reversible bag. In addition, FIG. 2D depicts a handle 23 permanently attached to the foundation bag 12 and not having a swivel portion. It is also further noted that non-reversible, permanently attached handles 23 can be used in other embodiments, instead of the reversible handle 30 coupled to the foundation bag 12 via multi-directionally oriented connectors, such as, for example, swiveled loops 32 and garments 28. However, if reversibility is not required, then non-reversible handles 23 can be used.

Figure 3:
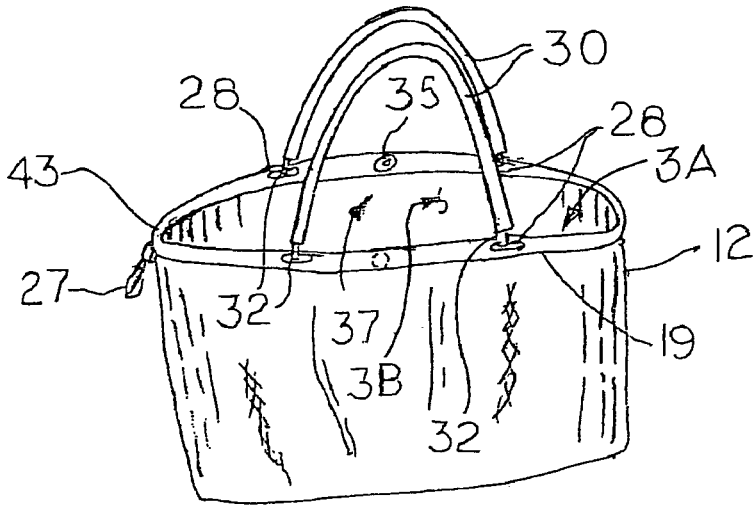
FIG. 3 is a perspective view of an embodiment of a foundation bag with an interchangeable reversible lining.
Figure 5:
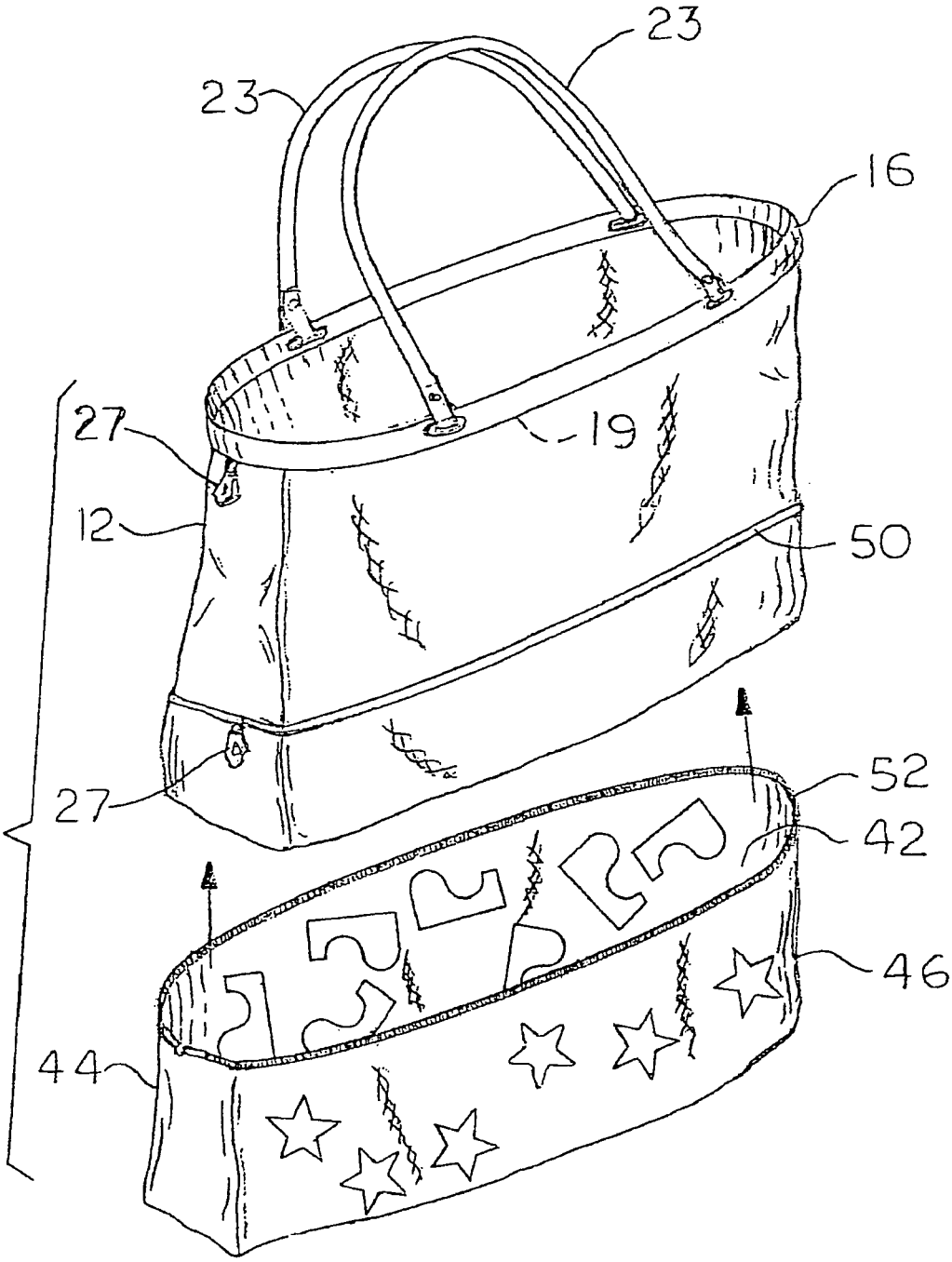
FIG. 5 is a perspective view of another embodiment of an interchangeable carry bag system showing a foundation bag and a different sized partial outer slipcover wherein the arrow indicates the sliding direction of the partial slipcover over the foundation bag.

FIG. 3 is a perspective view of an embodiment of a handbag system with an interchangeable lining 37. Specifically, FIG. 3 depicts a foundation bag 12 which can be made of various flexible materials including but not limited to leather, suede, silk, etc. The foundation bag 12 can be worn and used without the use of an outer slipcover 13 or 17 or without liner 37. The foundation bag 12 preferably has a first fastening closure structures 35, 36 (shown in FIG. 3C), attached to the foundation bag 12 for closing the foundation bag 12. The first fastening closure structures 35 and 36 may be opposite magnetic closures but is not limited to such, and can include a zipper, drawstring, snap, buckle, hook and loop or other closing mechanism capable of joining the opposing sides of foundation bag 12 together. For example, the first fastening structures 35 and 36 can be magnetic snap type fasteners of opposite polarity. Optionally the foundation bag 12 has a second fastening structure 19 (e.g., a zipper slide and pull portion) located on the outer surface of the foundation bag near the top periphery thereof as depicted in FIGS. 1 and 2. The second fastening structure 19 mates with the single post zipper portion 24 of a full sized non-reversible slipcover 13 or mates with a dual post zipper portion 29 of a reversible slipcover 17. Zipper slide and pull portion 50 may be located on the lower region of the foundation bag 12 as depicted in FIG. 5 to mate with a dual post zipper portion 52 of a partial sized slipcover 44. The location and number of second fastening structures, such as zipper slide and pull portions 19 or 50, located upon foundation bag 12, may vary depending on the size of outer slipcover 13, 17 or 44 being applied and the amount of versatility demanded by the consumer of the foundation bag 12. For example, a foundation bag 12 that contains three second fastening structures, such as zipper slide and pull portions 19, located at the top, middle and bottom regions respectively of foundation bag 12, can receive a variety of different sized slipcovers (full, mid region and lower region slipcovers respectively). However, the foundation bag 12 that contains only one second fastening zipper slide and pull portion structure 19 or 50 can receive one sized non-reversible outer slipcover 13, reversible outer slipcover 17 or partial outer slipcover 44.

The foundation bag 12 with a liner 37 is also depicted in FIG. 3 with a pair of straps 30 which together form a handle for holding the foundation bag 12. Straps 30 can be made of rigid or flexible material, including but not limited to leather, belting, cording, plastic, beading etc. Similar to straps 30 of FIGS. 1 and 2, the straps 30 may be interchangeable and may be fastened to the foundation bag 12 by a third multi-directionally oriented fastening structure such as swivelable loops 32 and grommet 28, as described before in FIG. 1. In addition to the advantages of the interchangeable straps 30 described above, the interchangeable straps 30 also allow the user to disconnect the straps 30 for a variety of other reasons e.g., to replace damaged, frayed straps; to change the original straps for another pair of straps 30 of a different length or style; and for aesthetic purposes of reversing the straps 30 to wear on the opposite side revealing a different color, or pattern, or to remove the straps 30 for a strapless clutch hand bag. The third fastening structure 28 and 32 is for illustrative purposes and is not intended in any way to limit the scope of the hardware or fastener used to connect the strap 30 to the foundation bag 12. It can also be appreciated that other embodiments of the invention can include other types of straps, such as non-reversible sewn-in straps 23 of FIG. 2D, the quantity of straps 30 or 23, or no strap at all.

Figure 3B:
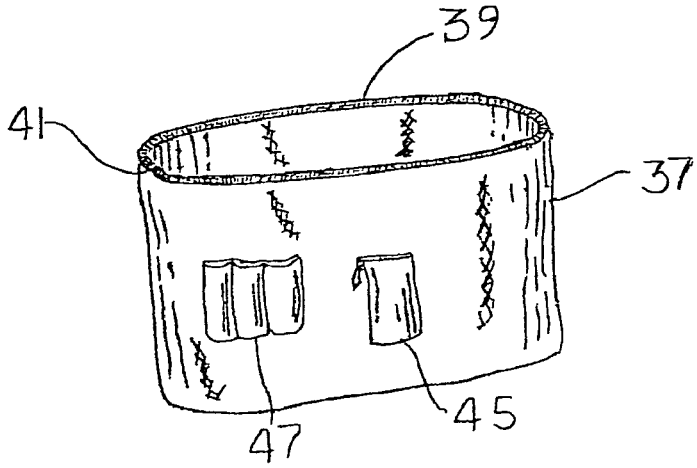
FIG. 3B is a perspective view of the lining as in FIG. 3, shown in a reversed inverted inside-out position.
Figure 3A:
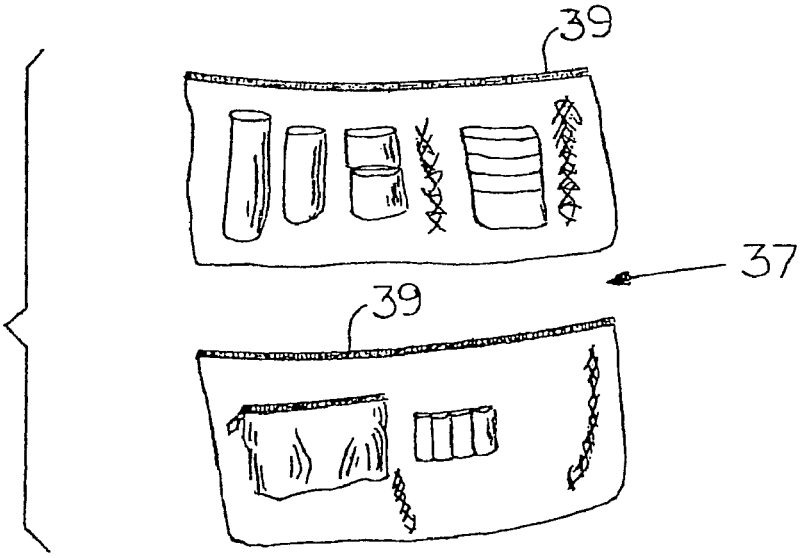
FIG. 3A is a perspective view of the inside walls of the lining as in FIG. 3, showing pockets for items of personal use.

FIGS. 3, 3A and 3B depict the preferably reversible lining 37 which can be made of various flexible materials including but not limited to cotton, polyester, silk, satin etc. FIG. 3A shows two inner side walls of the lining 37 in a first position of use with pockets for items of personal use such as a cell phone, glasses, tissues, keys, credit cards, as well as a large zipped compartment for miscellaneous items wherein the large compartment may have small subcompartments. For specialized bags, such as diaper bags, the compartments may include wet wipes, moist towelettes, diapers and/or change of clothes, etc. FIG. 3B shows lining 37 in a reverse, inverted, inside-out position. While lining 37 is preferably reversible so it can be used inside out, it can be provided also as a non-reversible lining. The lining 37 may be interchangeable and may be fastened to the foundation bag 12 by a fourth fastening structure 39, such as a zipper post portion, located along the top peripheral edge of the liner 37 and the corresponding zipper slide and pull portion 43 located along the top inside periphery of the foundation bag 12, so that when the post side 41 of the fourth fastening structure 39 is fed into the slide and pull side of the zipper portion 43 located on the inner upper surface of the foundation bag 12, the lining 37 and foundation bag 12 interlock in position. The optionally interchangeable liner 37 allows the user to remove the existing lining 37 for a variety of reasons e.g., for cleaning purposes, to discard and replace an irreparably damaged liner (e.g., ripped, soiled etc.) or for the aesthetic purpose of choosing another color, texture or pattern lining. Optionally lining 37 may be provided with dual post zipper portion 41 to facilitate the proper engagement with the zipper side and pull portion 43 on foundation bag 12. When turned inside out, the lining 37 may have inner compartments such as at least one zipper compartment 45 to keep items secure and one or more pockets 47 to hold various personal items such as keys, tissues, cell phone etc. The lining inner compartments 45 and/or 47 are for illustrative purposes and are not intended to limit the scope of the invention. As such, other embodiments of the invention can include other types and amounts of compartments with different closures. It is appreciated that the liner 37 may include more or less compartments than depicted in FIG. 3 or no compartments at all.

FIG. 3C is a top plan view of the foundation bag 12 of FIG. 3, shown closed by a fastener 35 attached to another fastener 36. Elements such as handles 30, loops 32, grommets 28 and foundation bag 12 have already been described with respect to FIGS. 1, 2, 2B, and 3. For brevity, those elements are not further described with respect to 3C. In addition to those elements already described, illustratively, fasteners 35 and 36 are depicted as magnetic type fasteners having two magnetic portions of opposite magnetic polarity. The magnetic attraction between magnetic portions 35, 36 and a snap feature is sufficient to hold the foundation bag 12 is a closed position when desired. Although FIG. 3C depicts the fasteners 35 and 36 as magnetic closures it is appreciated that any type of fastener can be used in accordance with the invention (e.g., snap, magnetic snaps, hook and loop VELCRO® fasteners or a zipper).

Figure 4:
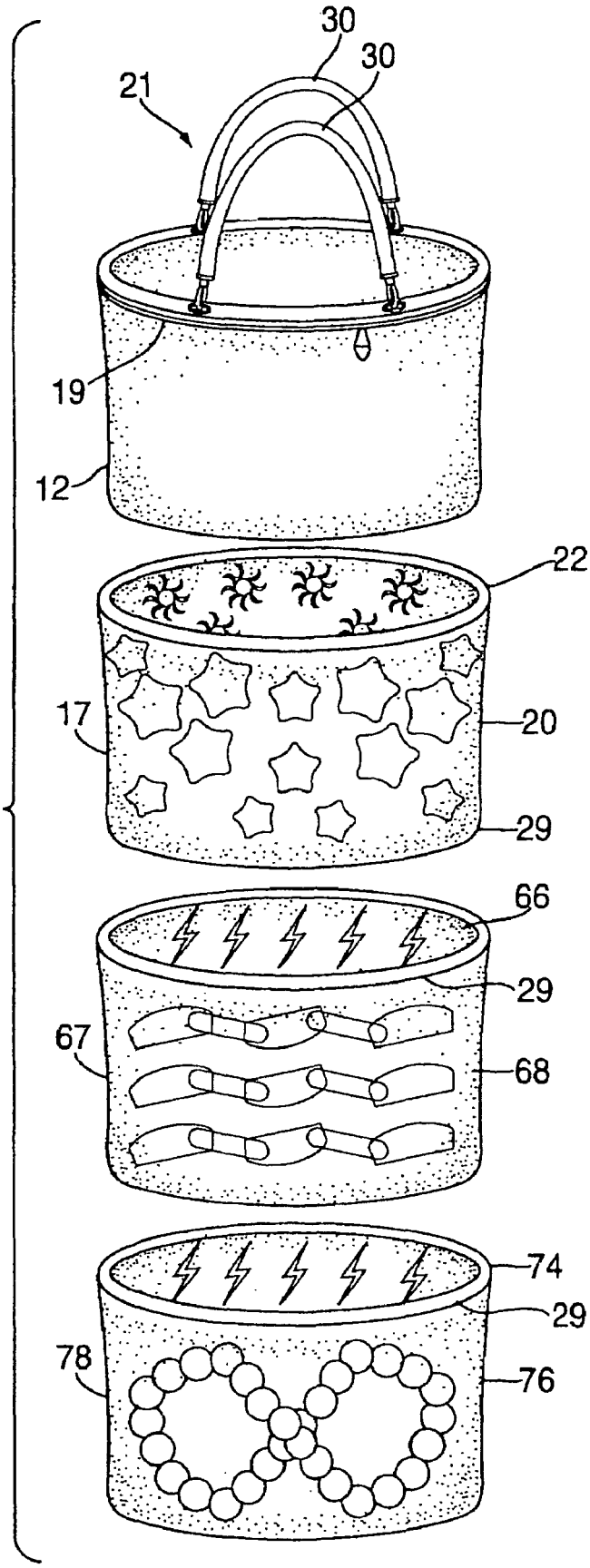
FIG. 4 is a perspective view of the interchangeable carry bag system of FIGS. 1 and 2, showing a foundation bag and multiple stackable and reversible outer slipcovers.

FIG. 4 is a perspective view of the interchangeable carry bag system 21 of FIG. 2 showing foundation bag 12 and multiple stackable outer reversible slipcovers 17, 67 and 78. Specifically, FIG. 4 shows the stackability aspect of multiple outer reversible slipcovers 17, 67 and 78. In addition to outer slipcover 17 described with respect to the embodiments of FIG. 2, FIG. 4 depicts two additional outer slipcovers (67 and 78). Each additional slipcover 67 and 78, as illustrated, is also reversible, however nonreversible slipcovers such as outer slipcovers 13 of FIG. 1 may be used, or a combination of reversible and nonreversible slipcovers may be used. Outer slipcover 67 includes a first inner surface 66 and second outer surface 68, and a dual post zipper portion 29. Outer slipcover 78 includes a first inner surface 74, a second outer surface 76, and a dual post zipper portion 29.

The embodiment depicted in FIG. 4 operates similarly to that described with respect to FIGS. 1-3. However, the outer slipcover 17 is not interlocked with foundation bag 12. Rather, the outer slipcover 17 is merely slipped over the foundation bag 12. Thereafter, outer slipcover 67 is slipped over outer slipcover 17 without interlocking the outer slipcover 67 to the foundation bag 12. Afterwards, outer slipcover 78 is slipped over outer slipcover 67 and interlocked to foundation bag 12 via the dual posted zipper 29 being inserted into the second fastening structure 19 of the foundation bag 12. The outer slipcovers 17 and 67 are nested between the foundation bag 12 and outermost slipcover 78 and therefore held in place by the interlocking of the foundation bag 12 with the outermost slipcover 78. Since the outer slipcovers 17, 67 and 78 are flexible, each can have the same size as each other slipcover. Inner placed slipcovers 17 and 67 are not fastened by zippers, but rather are loosely nested within each other. In this illustration of FIG. 4, each of the outer slipcovers 17, 67 and 78 allow the user two different appearances for the handbag system. Thus, the three outer slipcovers (17, 67 and 78) allow the user six different appearances for the foundation bag 12. In addition, the user has at their disposal a seventh appearance for the foundation bag 12 itself, if the user decides to use none of the outer slipcovers 17, 67 and/or 78, since the foundation bag 12 is a completely functioning handbag on its own. It is appreciated that the number of outer slipcovers 17, 67 or 78 can vary, depending on the needs of a particular user and that more or fewer reversible outer slipcovers 17, 67 or 78 and/or nonreversible outer slipcovers 13 may be used in accordance with the invention.

FIG. 5 is a perspective view of an embodiment of an interchangeable carry bag system showing a foundation bag and a shorter, different sized sleeve-like outer slipcover. FIG. 5 depicts some of the elements previously described with respect to FIGS. 1-4. For the purpose of brevity, the function and description of those elements is not repeated. In addition to those features previously described, FIG. 5 also depicts a second zipper post portion 52 located circumferentially on a top peripheral edge of an outer partial slipcover. The outer reversible slipcover includes a dual post zipper side portion 52, a first inner surface 42 and a second outer surface 46. The partial outer slipcover can optionally be non reversible and would therein include a standard single post zipper portion for purposes of interlocking itself to zipper slide and pull portion 50 located on the outer surface of the foundation bag 12. In FIG. 5 the partial slipcover may be slipped over the lower portion of the foundation bag 12 and interlocked using the zipper slide and pull portion 50 and dual post zipper portion 52. Although FIG. 5 depicts a single partial outer slipcover, it is appreciated that other partial slipcovers of the same size may be nested between foundation bag 12 and outer partial slipcover as similarly described with respect to FIG. 4.

It is appreciated that many different types (i.e. sizes and styles) and the amount of zippers place on the outside of the foundation bag 12 will vary and can also be used in accordance with the invention. It is also noted that the zipper slide and pull portions (19 and/or 50) located on the outside of the foundation bag 12 may be hidden via a flap of material on the foundation bag itself or it may be in full view and its function is also and aspect of its design.

Figure 6A:
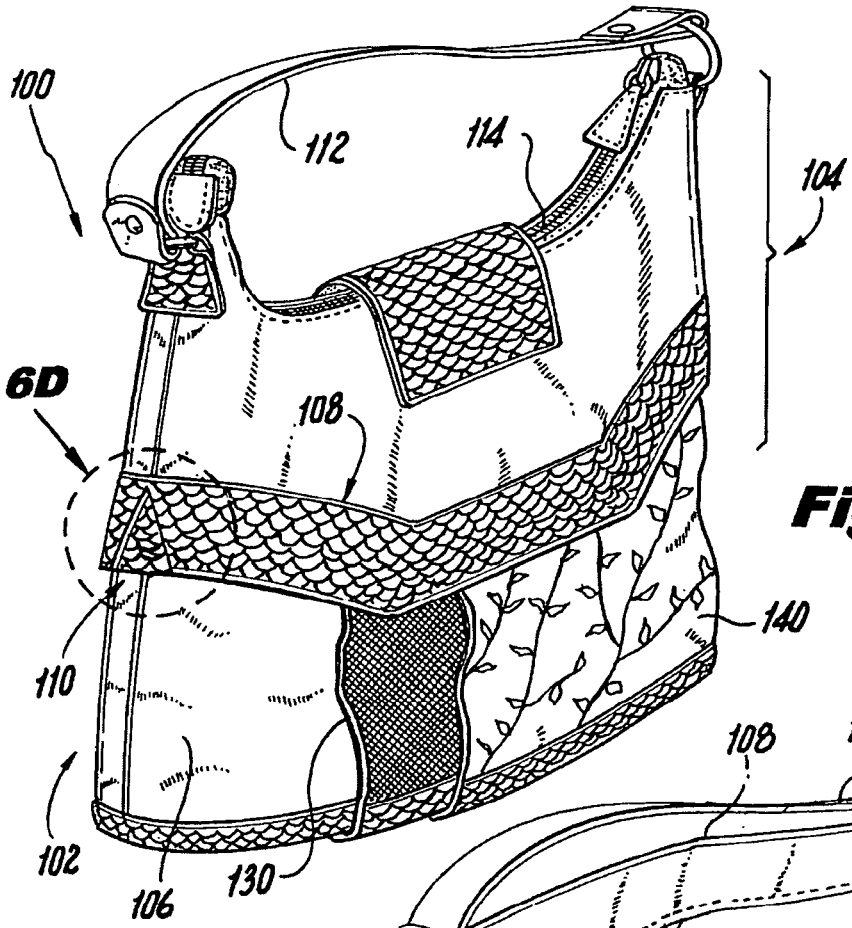
FIG. 6A is a perspective view in partial cutaway of an alternate embodiment for handbag system including a bag with an inner skirt, an outer flap, and multiple attachable, stackable and interchangeable outer slip covers, which may be optionally reversible.
Figure 6B:
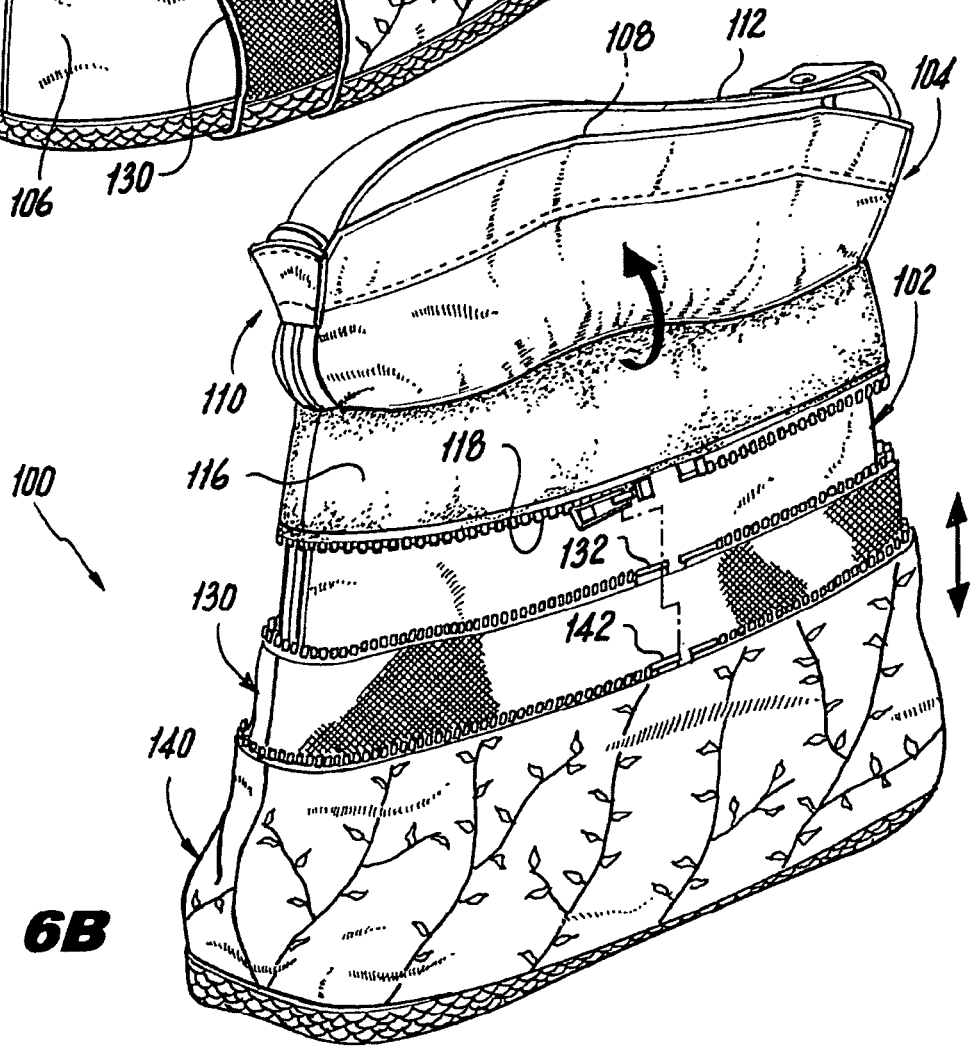
FIG. 6B is an exploded perspective view thereof, shown with the outer flap pulled upward to reveal the inner skirt.
Figure 6C:
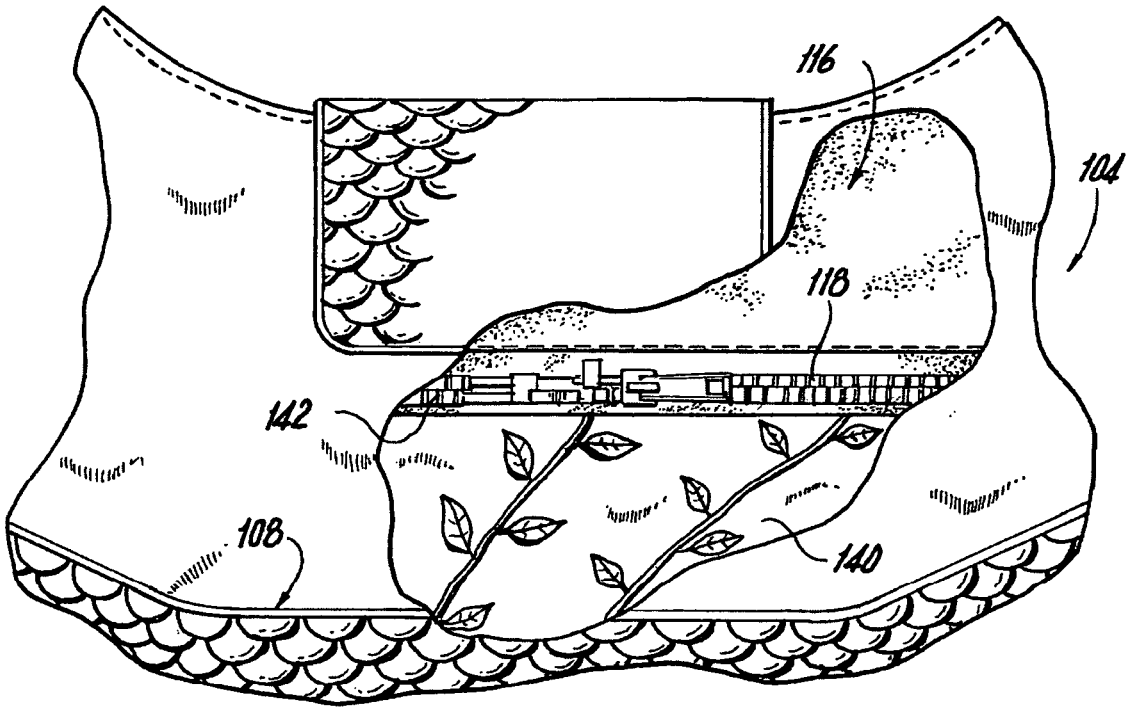
FIG. 6C is a close up elevational view of the handbag system of FIG. 6A, shown with an inner skirt, and shown in partial cutaway, wherein the connection interface is a dual post zipper.

Foundation bag 100 of this invention, as shown in FIGS. 6A, 6B and 6C, is an example of a fully functional handbag with permanently attached outer flap 104 whose lower edge is shaped with trapezoidal demarcation element 108 (connected to foundation bag 102), wherein foundation bag 102 is connected at the top by handle 112 and zipper or other closure 114. While the bag may have as little as one outer slip cover, FIG. 6A shows an example with two reversible outer slip covers 130 and 140 covering lower portion 106 of foundation bag 102, wherein the connection interface, such as slide and pull half portion 118 of dual post zipper and dual post portion 132 and 142 of FIG. 6B, is covered by an outer flap of any geometrical configuration, such as in this example, a trapezoid shape outer flap.

FIG. 6B shows the handbag system of the hobo embodiment of FIG. 6A, wherein trapezoidal demarcation element 108 of outer flap 104 is lifted up to reveal inner skirt 116 having zipper slide and pull half portion 118 of a dual post zipper connected thereto for engagement with dual post portion 132 of the connection interface, such as a dual post zipper, between foundation bag 102 and one or more outer slip covers 130 and 140. It is noted that outer flap 104 covers inner skirt 116. Inner skirt 116 allows a zipper, when placed horizontally, to engage foundation bag 102 with outermost slip cover 140. A zipper placed along most non linear edges, i.e. trapezoidal edges, wavy edges or sharp curves, does not glide either at all or smoothly. Zippers are inherently used along straight edges. Moreover, it is noted that upper zipper slide and pull half portion 118 can mate with either dual post zipper portion 132 of reversible slip cover 130 or if inner slip cover 130 is stacked within outer slip cover 140, then upper zipper slide and pull half portion 118, which is connected to inner skirt 116, may mate with zipper post half portion 142 of outer slip cover 140 of handbag system 100. This mating results in slip cover 130 being nested between foundation bag 102 and outermost slip cover 140. It is further noted that if slip covers 130 and 140 are not reversible, then dual post zipper 118, 132 or 118, 142 can be a conventional non-dual post zipper.

It is noted that while handbag system 100 is depicted as a hobo style handbag, which is for illustrative purposes only and that other bag styles such as the tote bag, messenger bag, backpack, diaper bag, clutch or other style handbags may be applicable.

FIG. 6C is a close up detail view of FIG. 6B, of the connection interface of outer flap portion 104 of foundation bag 102 having outer flap 104, with its trapezoidal trim element 108 covering the connection interface, which includes inner skirt 116, having at its lower distal end upper slide and pull half portion 118 of a dual post zipper, which mates with the lower post half portion of at least one outer slip cover, such as slip cover 140, which is depicted having post half portion 142 attached along the top peripheral edge thereof.

Figure 6D:
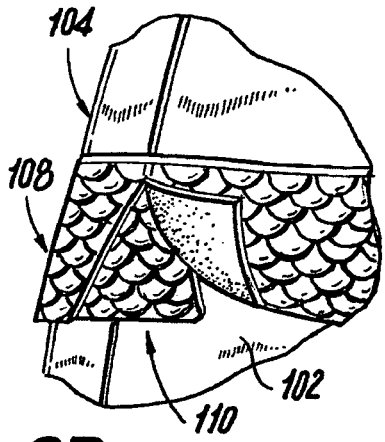
FIG. 6D is a close up perspective view of the venting system which includes a vertical slit and an optional tab of the handbag system, taken along the dotted view line in the circle "6D" on a textured side of FIG. 6A.
Figure 6E:
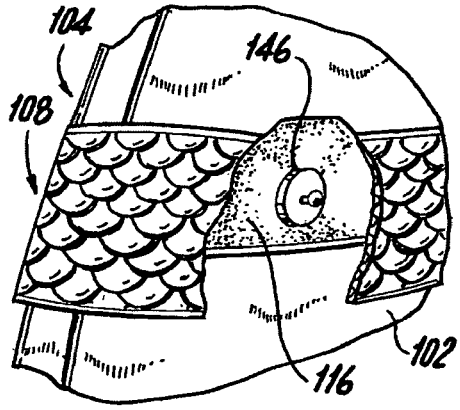
FIG. 6E is a close up perspective view in partial cutaway of an end portion of the outer flap as in FIG. 6A, but shown without a vent and showing a fastening device attached to the inner skirt, wherein the fastening device may be a snap.

In FIG. 6D, a venting of outer flap 104 is used in order to provide further flexibility in lifting up outer flap portion 104. Venting system 110 is a vertical or otherwise slit and an optional tab, which may be provided at the sides of handbag system 100, which separates the front and rear portions of outer flap 104. Venting system 110 may extend up along any portion of outer flap 104, or partially as shown on trapezoidal edge 108. It is noted that an optional tab may be added to the underside of the slit of venting system 100, to cover the connection interface fastening structures underneath.

Figure 6F:
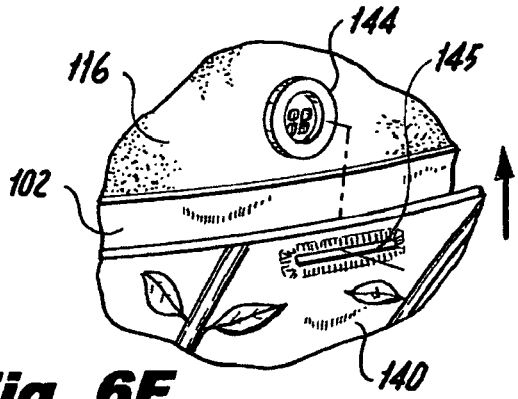
FIG. 6F is a close up perspective view of an alternate embodiment for a connection interface including a button attached to the inner skirt and aperture provided therefor.

While FIG. 6C shows a dual post zipper as the connection interface between foundation bag 102 and at least one slip cover 140, in FIG. 6F inner skirt 116, located under outer flap 104, contains reciprocating fastener button member 144 engageable with reciprocating fastener 145, such as a button hole member located on outer slip cover 140, wherein outer flap 104 covers user operable fastener 144. It is further noted that the plurality of fasteners 144, such as buttons, snaps, hooks, buckles, turn locks or other fasteners known to those skilled in the art, may be provided in an array for attaching the outer slip cover 140 to foundation bag 102. This optional array may preferably be comprised of an extended arrangement of a plurality of spaced apart fasteners, wherein the array is preferably comprised of at least three such fasteners in a group, and wherein the array is comprised of at least two such groups of fasteners, with one group of discrete user operable fasteners located on a front of foundation bag 102 and another group of discrete user operable fasteners located on a rear of foundation bag 102.

Figure 6G:
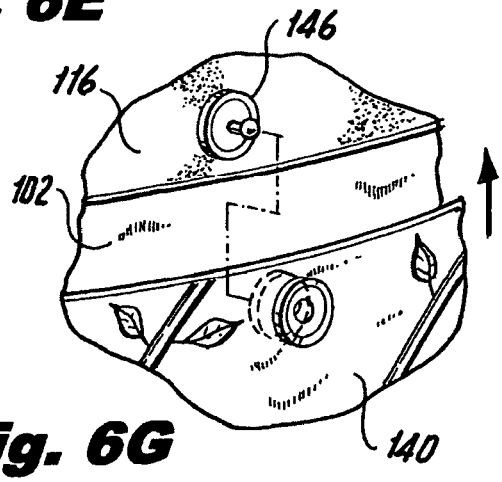
FIG. 6G is a close up view of a further alternate embodiment for a connection interface beneath the outer flap of FIG. 6A showing a snap with a reciprocating protruding portion attached to the inner skirt.

FIG. 6G shows a further alternate embodiment, wherein the connection interface comprises one or more, preferably a plurality, of snaps 146 attached to inner skirt 116 and being engageable with, and reciprocating with, snap protrusions upon outermost slip cover 140 and under outer flap 104. It is noted that the reciprocating male or female portions of the snaps 146 can be alternatively on either portion of the foundation bag wall, the permanently attached flap thereof, the inner skirt or the slip cover. In embodiments of the present invention where the slip cover is reversible, the receiving end of the fastener is placed on both sides of the slip cover.

Figure 7A:
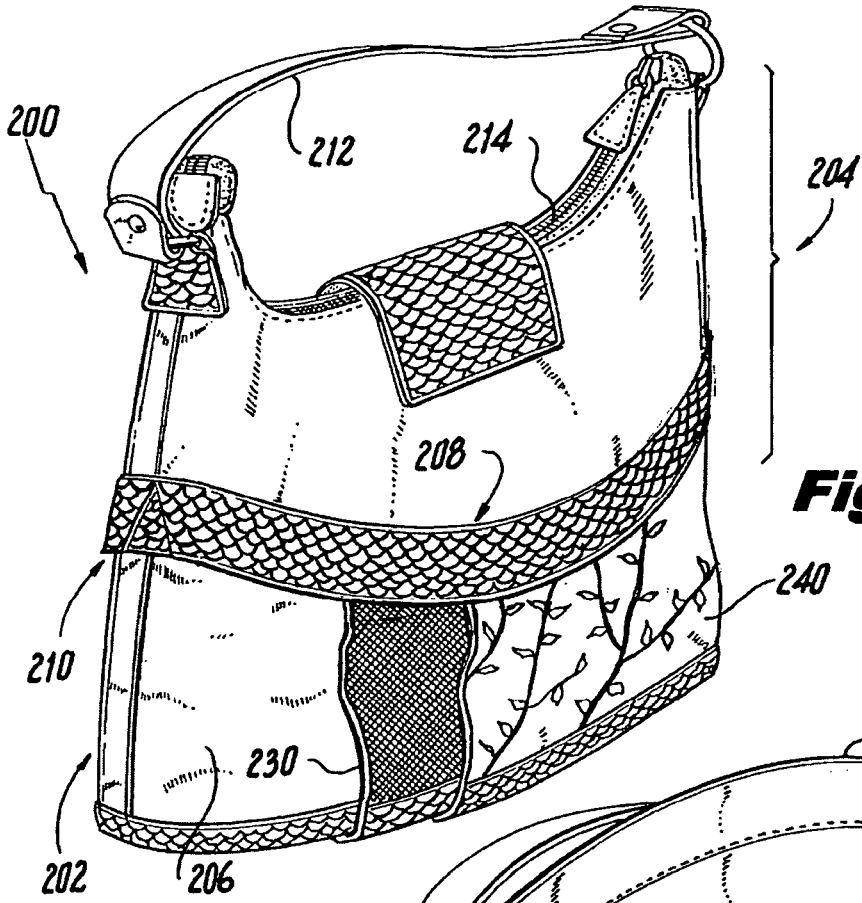
FIG. 7A is a perspective view in partial cutaway, of an alternate embodiment for a hobo-style handbag system showing a curved outer flap over the interface between the outermost outer slip cover and the foundation bag.

FIG. 7A shows a further embodiment for handbag system 200, with a different curved configuration for outer flap 204, wherein curved demarcation edge 208 of outer flap 204 covers one or more of outer slip cover 240 and/or intermediary slip cover 230 over fully functional foundation bag 202, having attached thereto outer flap 204 with curved demarcation edge 208. Optional vent 210 is provided for handbag system 200, which further includes handle 212 connected to upper portion 204 of foundation bag 202 and an upper zipper closure member known to those skilled in the art, such as an additional security closure flap extending generally perpendicularly or even angularly over zipper 214 located at the top of foundation bag 202, on outer flap 204.

Figure 7B:
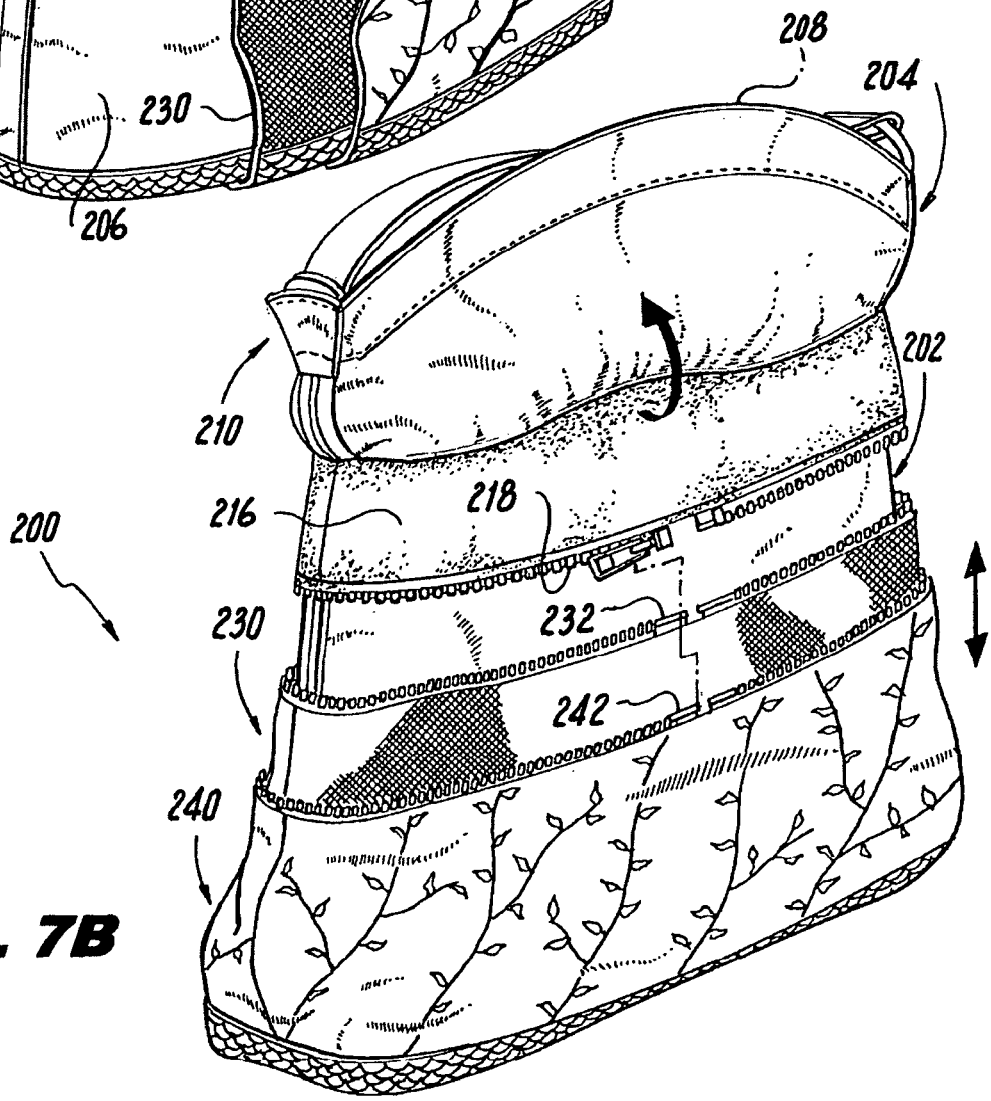
FIG. 7B is a perspective view of an alternate embodiment for a handbag system as in FIG. 7A with a curved outer flap, which is shown raised, to expose the connection fastener being an optional dual post zipper with a slide and pull one half portion of it attached to the bottom peripheral edge of an inner skirt of a foundation bag and the dual post half portion thereof attached to the horizontal top peripheral edge of the outermost slip cover.

FIG. 7B is an exploded view of the hobo style embodiment of FIG. 7A, wherein outer flap 204 with curved demarcation edge 208 is lifted up to reveal inner skirt 216 having at the lower peripheral edge thereof, zipper slide and pull half portion 218 (of a dual post zipper,) engageable with either-dual post half portion 232 (if one reversible slip cover 230 is applied) or with dual post half portion 242 (if reversible slip cover 240 is applied,) or, if optionally two slip covers (such as slip covers 230 and 240) are stacked, as shown in FIG. 7B.

FIGS. 6A, 6B, 7A and 7B show multiple outer slip covers, including intermediate slip cover 130 or 230 and outer slip cover 140 or 240 with dual post zippers. It is further noted that dual post zippers are mainly needed if intermediate slip covers 130 and 230 and/or outer slip covers 140 or 240 are reversible. If, in fact, intermediate slip covers 130, 230 and/or outer slip covers 140 and 240 are not reversible, then a conventional single post zipper may be used.

Figure 8A:
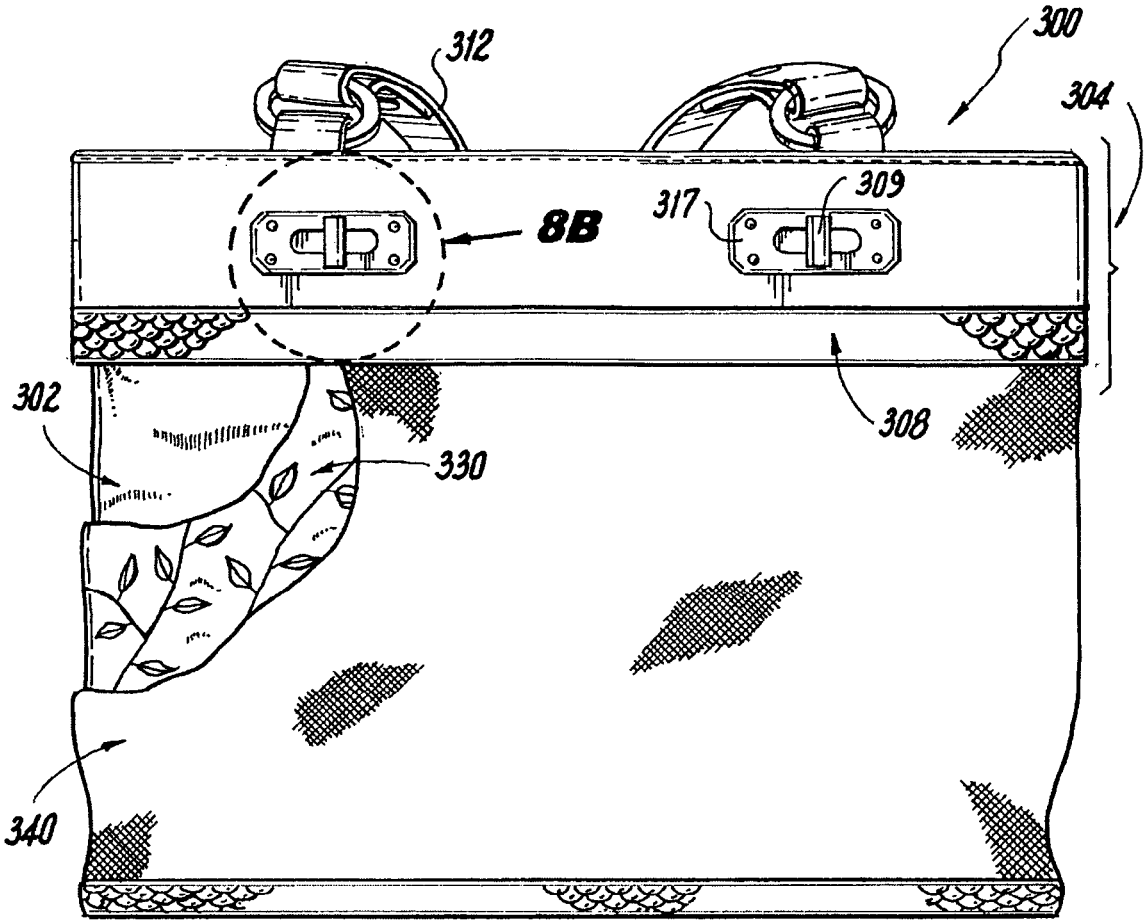
FIG. 8A is a front elevational view of a tote-style handbag system with a horizontal linear outer flap whose connection interface between the outermost stackable slip covers and the foundation bag is a plurality of turn locks, where it is understood that the slip covers may be either reversible or non-reversible.
Figure 8B:
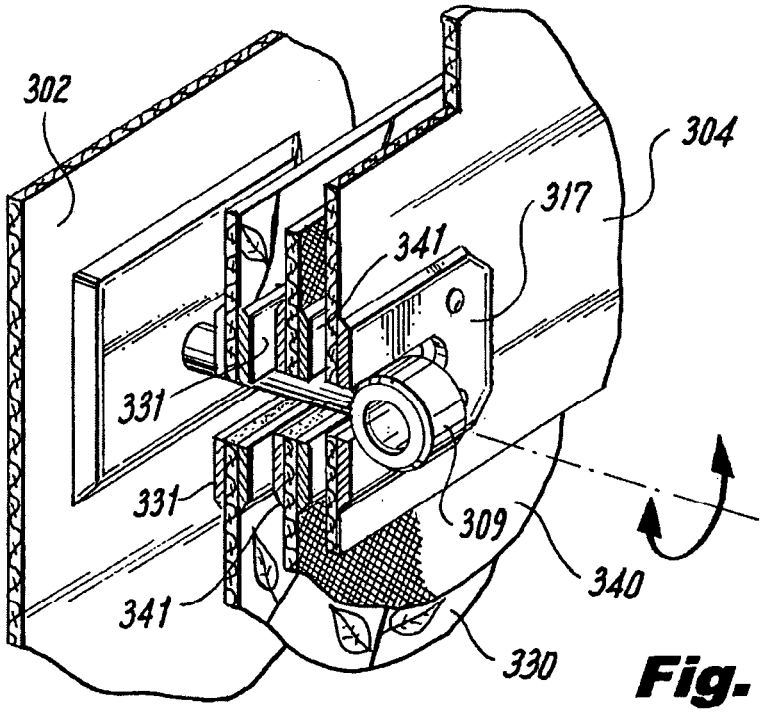
FIG. 8B is a close up exploded perspective view of a turn lock closure portion of the tote bag shown in FIG. 8A, taken along the dashed view lines in the circle "8B" shown in FIG. 8A.

FIGS. 8A and 8B shows tote-style handbag system 300 including foundation bag 302 having permanently attached horizontal linear outer flap 304 whose connection interface between stackable slip covers 330 and 340 and foundation bag 302 is a plurality of turn locks 309. FIG. 8A also shows a handle 312 connected by conventional connections to top region 304 of foundation bag 302. It is noted that optionally a single slip cover 330 or 340 may be utilized with foundation bag 302 and turn locks 309.

It is understood that slip covers 330 and 340 may each be a reversible one or a non-reversible one. Turn locks 309 are similar in general to conventional turn locks for handbags, such as disclosed as reference numeral "48" in U.S. Pat. No. 6,135,179 of Joyner.

The close up exploded perspective view of FIG. 8B depicts a portion of tote bag 300 shown in FIG. 8A. When viewing FIG. 8A, FIG. 8B is viewed along the dashed lines in circle "8B". The bi-directional curved arrow shown in FIG. 8B indicates the axial pivoting of turn lock 309. The outer distal head of turn lock 309 attached to the upper portion of foundation bag wall 302 passes first through an eyelet in locking plate 331 of slip cover 330, next through an eyelet in locking plate 341, which is attached to slip cover 340. The eyelets through plates 331 and 341, attached to slip covers 330 and 340, are located in positional register with the eyelet in plate 317, located on outer flap 304 of foundation bag 302. In operation, the outer restraining head of lock 309 is turned axially to alternately lock or unlock slip covers 330 and 340 from foundation bag 302. It is also noted in FIGS. 8A and 8B that a slit similar to that of FIG. 6A, except its cut is longer along the entire height of outer flap 304, may be made into outer flap 304 on each side and may extend up to the dotted stitch line at the top of outer flap 304, to enable flap 304 to be lifted up above the turn lock mechanism 109, so that covers 330 and 340 can be easily attached.

Figure 8C:
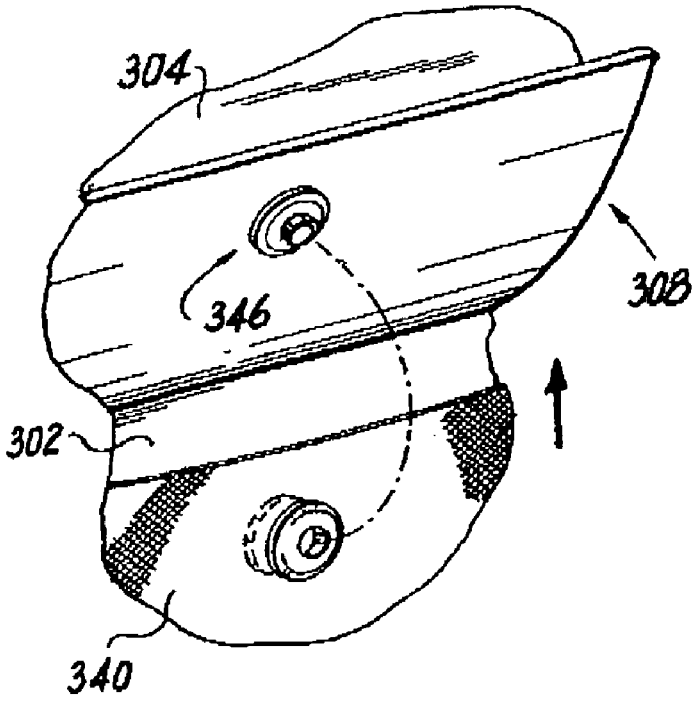
FIG. 8C is a close up detail view of a tote bag as in FIG. 8A, wherein the linear connection interface is one or more snaps and reciprocating protrusions attached to the underside of the outer flap and to the outer side of an outermost slip cover.

While the demarcation edge region 308 of outer flap 304 is shown as a linear edge region, it is noted that demarcation edge region 308 can optionally take on many geometric shapes. It is further noted that demarcation edge 308 may extend across an array of user operable fasteners such as snaps 346 (as shown in FIG. 8C) having reciprocal portions connected to an inner portion of outer flap 304 and an outer portion of outer slip cover 340 or outer and inner portions of outer slip cover 340 if it is reversible.

Figure 8D:
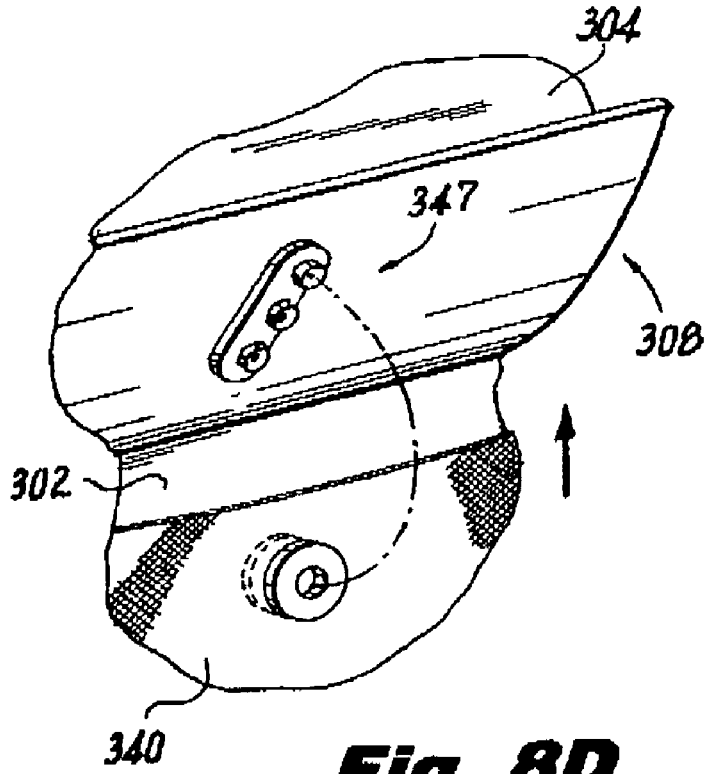
FIG. 8D is a close up detail view of the tote handbag system as in FIG. 8A shown with a snap attached to the underside of the outer flap, and reciprocating protrusions with adjustable sizes attached to an outer side of the outermost slip cover.

Also as shown in FIG. 8D, the user operable fasteners may be adjustable such as shown as adjustable snap 347 located on the inner portion of flap 304 along lower demarcation edge 308 with a reciprocating portion attached to an outer surface of outer slip cover 340.

Figure 8E:
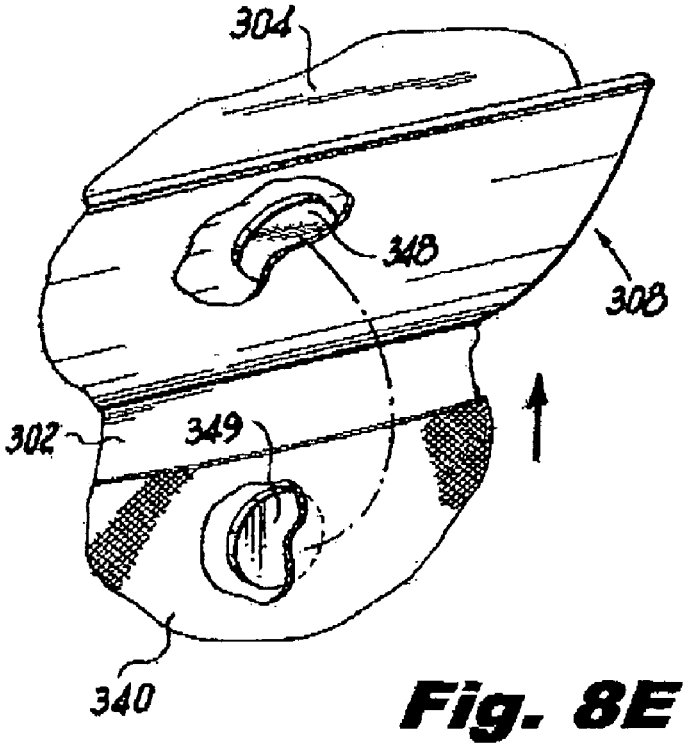
FIG. 8E is a close up detail view of the tote handbag system as in FIG. 8A showing a concealed sewn in magnetic attachment on the underside of the foundation bag outer flap, which is raised to expose the connection interface of a reciprocating sewn in magnetic attachment on the outermost cover.
Figure 8E:
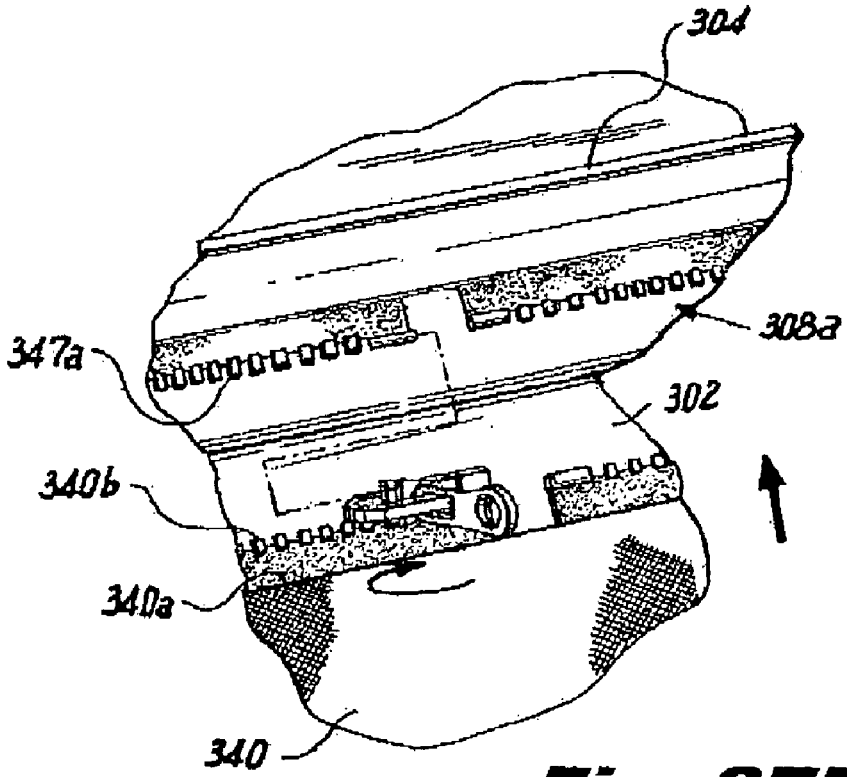

Likewise in FIG. 8E, an array of other types of fasteners, such as for example, concealed sewn in magnet 348, located on the inner side portion of outer flap 304 and along the bottom (for example, along horizontal demarcation edge region 308 of foundation bag 302), engages magnetically with sewn in magnet 349 located within outer slip cover 340. This optional array may preferably be comprised of an extended arrangement of a plurality of spaced apart fasteners 348, 349, wherein the array is preferably comprised of at least three such fasteners 348, 349 in a group, and wherein the array is comprised of at least two such groups of fasteners 348, 349, with one group of discrete user operable fasteners 348, 349 located on a front of foundation bag 302 and another group of discrete user operable fasteners 348, 349 located on a rear of foundation bag 302. FIG. 8EE is a close up detail view of the tote handbag system as in FIG. 8A showing a concealed dual post zipper portion 347*a* of a dual post zipper attachment hidden under flap 304 of foundation bag 302. The dual post portion 347*a* is shown on the underside 308*a* of flap 304 of the foundation bag 302. which is raised to expose the connection interface of reciprocating pull tab zipper portion 340*b*. having a reversible zipper pull tab, of the dual post zipper attachment to the top peripheral edge 340*a* of slip cover 340. The directional arrow indicates the movement of the pull tab of the pull tab zipper portion 340*b* within respective upper and lower channels of a pull tab housing. Depending on which side of outer slip cover 340 is on the outside, the pull tab moves within the channels to switch positions when the slip cover 340 is turned inside out. The pull tab zipper portion itself and its location under the flap 304 shown are illustrative, and it is noted that other pull tabs may be used as known to those skilled in the art of dual post zippers. It is further noted that the dual post zipper portion of the dual post zipper can be otherwise positioned under the flap 304 for connecting slip cover 340 to foundation bag 302.

Figure 8F:
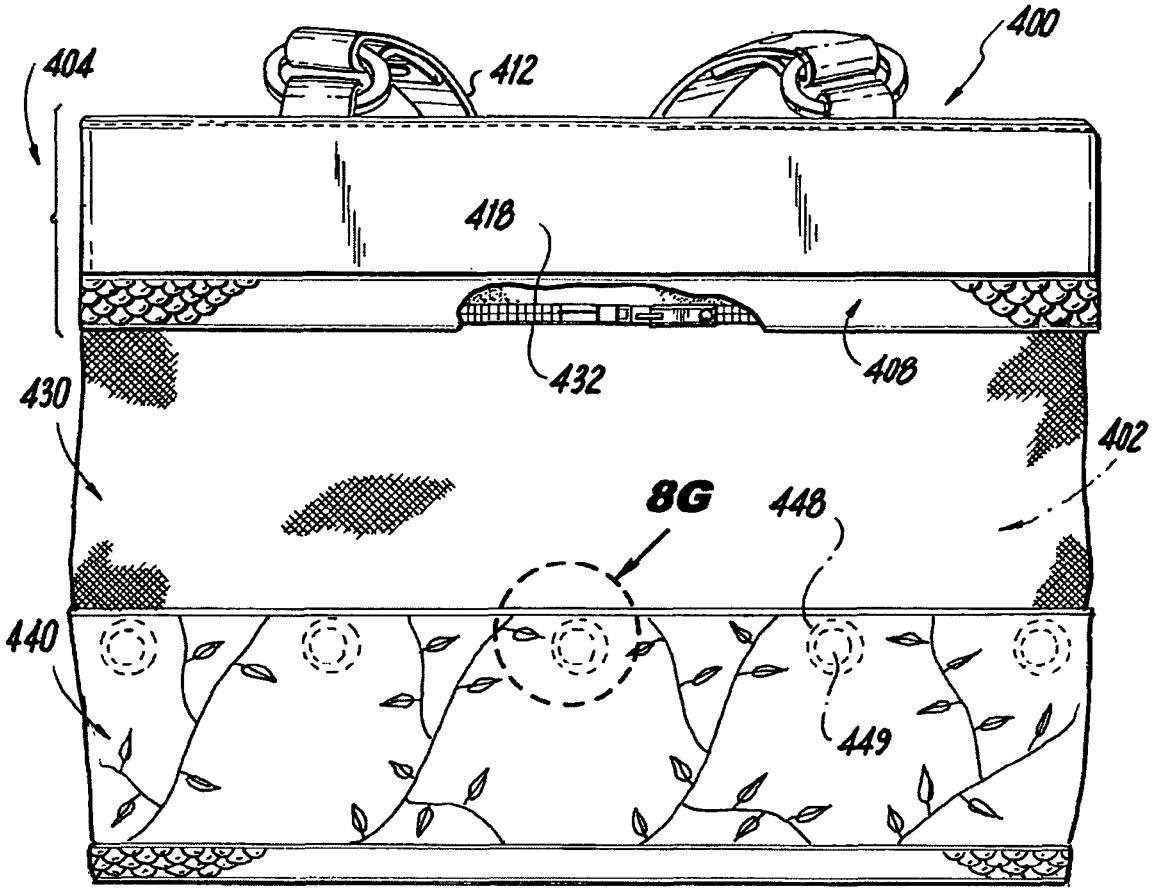
FIG. 8F is a further embodiment for a tote handbag system having a plurality of connection interfaces, including an outer flap covering a connection interface, shown in partial cutaway detail, as an exemplary dual post zipper and a lower, shorter outer slip cover being connected to an intermediate slip cover by a connection interface, which includes a plurality of manually operable concealed sewn in fasteners.
Figure 8G:
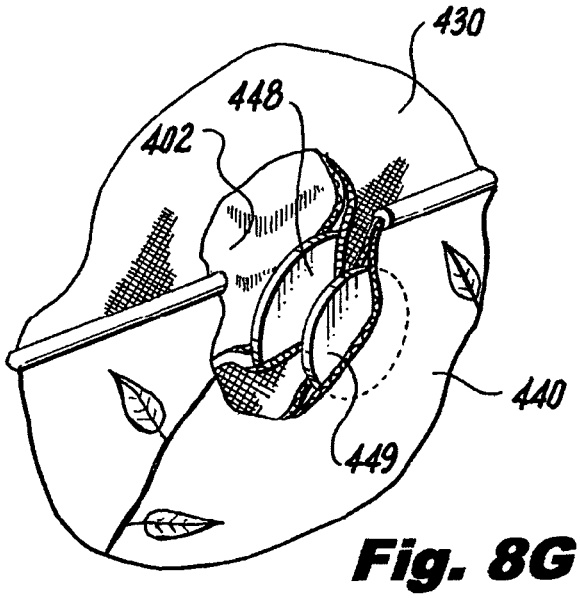
FIG. 8G is a close up perspective detail view in partial cutaway, as viewed in the dashed line of circle "8G" in FIG. 8F, of one of the concealed manual user operable fasteners shown in FIG. 8F.

FIGS. 8F and 8G show a different tote style handbag system 400 embodiment, but wherein outer partial slip cover 440 is connected by a linear array of a plurality of discrete user operable fasteners, such as concealed sewn in magnets 448 and 449 of opposite polarities, wherein magnet 448 of the pair of polar side magnets is concealed and sewn into (or otherwise attached to) optional intermediate slip cover 430 and opposite polar magnet 449 is concealed and sewn into (or otherwise attached to) outermost slip cover 440, thus attracting and holding outermost slipcover 440 to intermediate cover 430. An array of a plurality of sewn in magnets 448 and 449 of opposite polarities may also connect a single slip cover 430 or 440 to foundation bag 402. This optional array may preferably be comprised of an extended arrangement of a plurality of spaced apart fasteners 448, 449, wherein the array is preferably comprised of at least three such fasteners 448, 449 in a group, and wherein the array is comprised of at least two such groups of fasteners 448, 449, with one group of discrete user operable fasteners 448, 449 located on a front of foundation bag 402 and another group of discrete user operable fasteners 448, 449 located on a rear of foundation bag 402.

However, more than one fastener system can be used in the handbag system of the present invention. For example, as also shown in FIG. 8F, in addition to the array of magnets 448 and 449 shown attaching short outer slip cover 440, intermediate slip cover 430 is shown engaged via dual post zipper, which includes slide and pull portion 418 attached to the inner skirt of foundation bag 402 and post half portion 432 attached to intermediary slip cover 430. It is noted, however, that intermediary cover 430 is optional and that a handbag system may have only inner foundation bag 402, and, unlike Dalsheim '404, at least one slip cover 440, which completely circumferentially and continuously covers foundation bag 402 in a horizontal side-to-side plane. Additionally, at least one slip cover partially or fully circumferentially and continuously covers foundation bag 402 in a horizontal side to side plane, while partially or fully covering foundation bag 402 in a vertical top to bottom plane, up to its top edge.

FIG. 8G is a close up exploded perspective cutaway detail view depicting a portion of handbag system 400 shown in FIG. 8F. As noted before, when viewing FIG. 8F, FIG. 8G is viewed along the dashed lines in circle "8G". FIG. 8G shows discrete user operable fasteners (such as magnets 448 and 449 of opposite polarities) being depicted as a matching pair, where one of polar side magnets 448 is concealed and sewn into intermediate slip cover 430, and opposite polar magnet 449 is concealed and sewn into outermost slip cover 440. FIG. 8F also shows in dashed hidden lines an array of other pairs of fasteners, such as pairs of magnets 448 and 449 of opposite polarities attaching short outer slip cover 440 to intermediary slip cover 430.

Figure 8H:
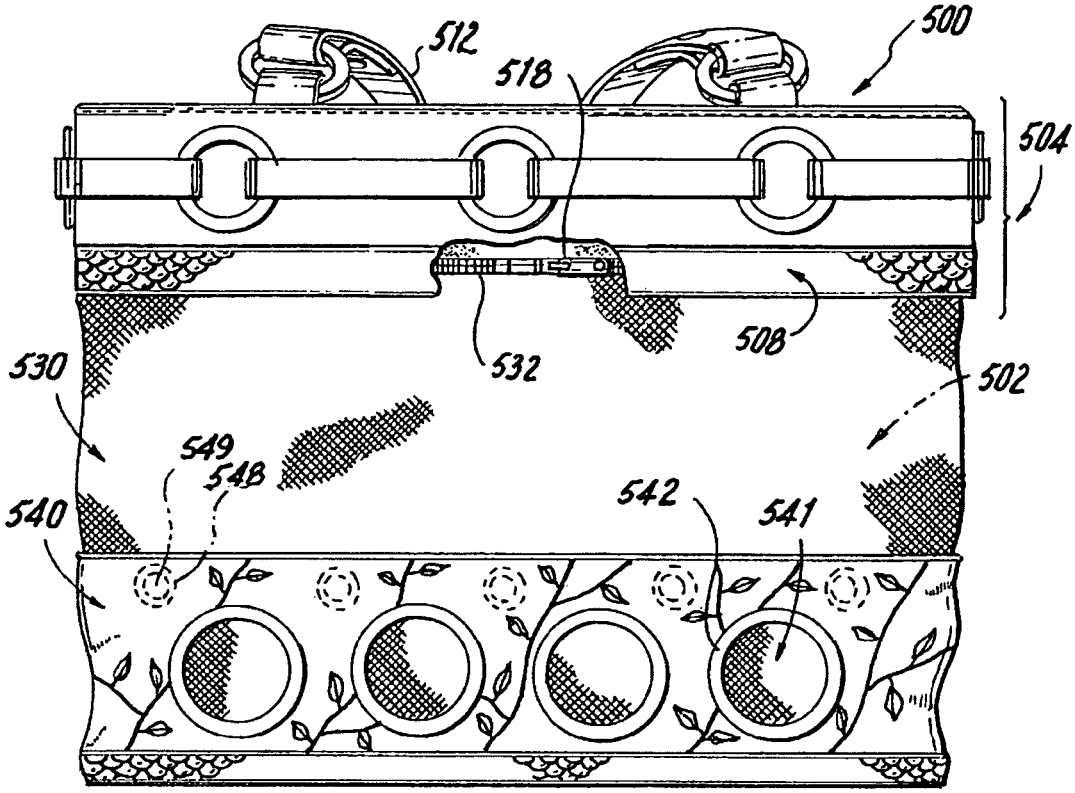
FIG. 8H is an alternate embodiment for a handbag system showing an outer flap covering a zipper connection interface between a foundation bag and an intermediary slip cover and showing a short outer slip cover connected by a plurality of discrete user operable fasteners (such as concealed sewn in magnets), and further showing one or more closed, peripheral edged apertures in the shorter outer slip cover, to reveal the surface of the intermediate slip cover.
Figure 8I:
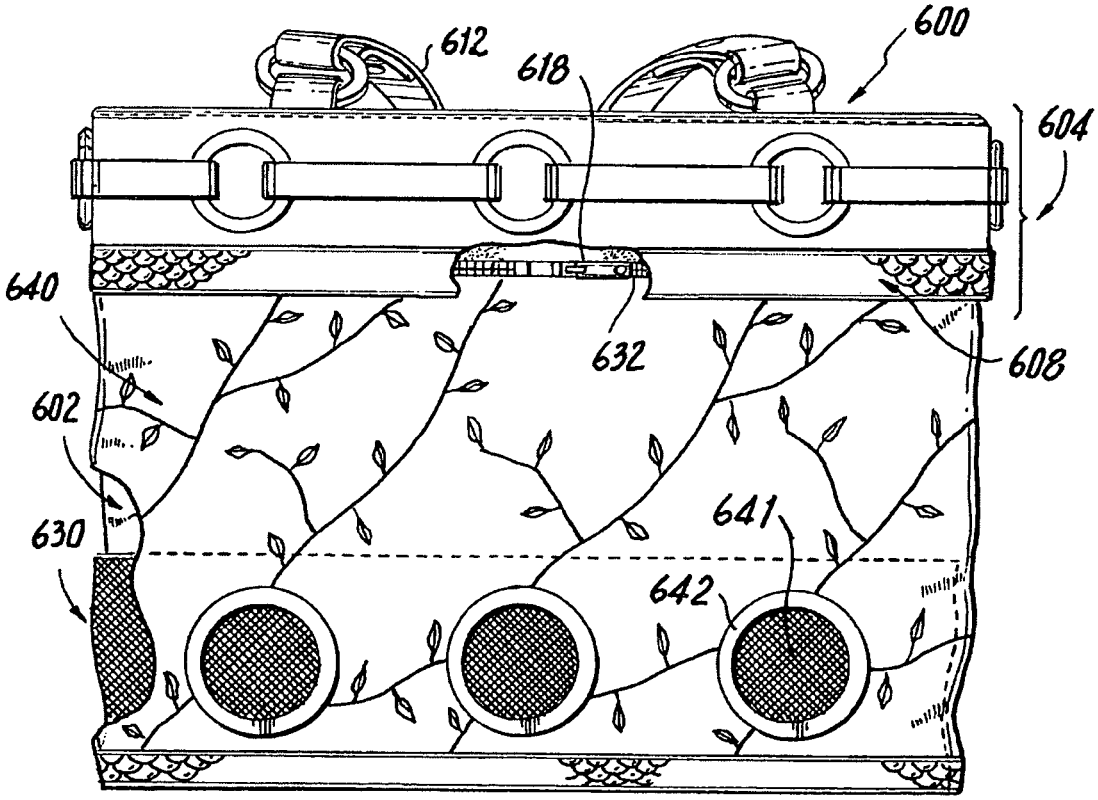
FIG. 8I shows a further embodiment for a handbag system with an outer flap covering a zipper interface between a foundation bag and an outer slip cover, wherein the outermost slip cover has one or more closed, peripheral edged apertures exposing the surface of the intermediary nested stacked slip cover or the foundation bag (not shown).

While aforementioned versions show the outer slip covers such as slip covers 130 and 230, etc., covering the lower portion of foundation bags 102, 202, etc., as in aforementioned drawing FIGS. 6A and 7A, it is further noted that in FIGS. 8H and 81, handbag system 500 includes one or more outer slip covers, such as slip covers 530 and 540 shown in FIG. 8H, which may have closed circumferential or otherwise peripheral edged apertures 541, optionally edged by decorative metal rings 542, which allows the user to view intermediate slip cover 530 through each aperture 541. Outer short slip cover 540 may be optionally attached by a connection interface such as zipper (not shown) or by an array of discrete user operable fasteners such as concealed sewn in magnet half parts 548 and 549, which attach short outer slip cover 540 to intermediary longer slip cover 530 having zipper post half portion 532 attached to its upper peripheral edge connected to zipper slide and pull half portion 518 of foundation bag 502. This optional array may preferably be comprised of an extended arrangement of a plurality of spaced apart fasteners 548, 549, wherein the array is preferably comprised of at least three such fasteners 548, 549 in a group, and wherein the array is comprised of at least two such groups of fasteners 548, 549, with one group of discrete user operable fasteners 548, 549 located on a front of foundation bag 502 and another group of discrete user operable fasteners 548, 549 located on a rear of foundation bag 502.

Likewise in FIG. 81, handbag system 600 includes full size outer slip cover 640, having closed circumferential or otherwise peripheral edged apertures 641 associated with optional decorative grommet rings 642. Outer slip cover 640 may connect to foundation bag 602 via a connection interface, such as zipper post half portion 632 engageable with zipper slide and pull half portion 618 located under outer flap 604 of foundation bag 602 of handbag system 600. Optional intermediate slip cover 630 or a decorative portion may be exposed view-through apertures 641 that have a closed circumferential or otherwise peripheral edge. Optional slip cover 630 is connected to foundation bag 602 by nesting in between foundation bag 602 and outer cover 640 or by concealed sewn in magnets, or other connection fastening devices, on the foundation bag and cover (not shown).

It should also be noted that the fastening structures of FIGS. 8A through 8E can be located anywhere along the top, middle or lower portions of the foundation bag wall, outer flap or optional inner skirt as design of the handbag allows.

FIGS. 9A and 9B are an example of a further embodiment of a handbag system 700 for a hobo style bag which has no inner skirt, (such as inner skirt 116 shown in FIGS. 6B, 6C, 6F and 6G, or inner skirt 216 shown in FIGS. 7A and 7B). Rather, handbag system 700 includes foundation bag 702 and one or more slip covers 730 or 740 covering a portion of foundation bag 702. Foundation bag 702 has upper portion 704 from which is permanently attached outer flap 708 at joinery edge 704[1] with optional vent 710 shown in FIG. 9A only. Foundation bag 702 also includes foundation bag closure portion 714 and handle 718. However, as shown in FIG. 9B, outermost slip cover 740 and intermediary slip cover 730 are attached to a lower region of foundation bag 702, by a connection interface such as the array of discrete user operable fasteners, such as magnets 748 and 749 of opposite polarities, with mating sides, as shown in FIG. 9B. Each magnet 748 is attached to the underside of outer flap 708 to receive respective reciprocal outer cover magnet 749. Intermediate slip cover 730 is nested in between outer slip cover 740 and foundation bag 702 or else it has magnets which are concealed and sewn into optional intermediary slip cover 730 and also to the wall of foundation bag 702. This optional array may preferably be comprised of an extended arrangement of a plurality of spaced apart fasteners 748, 749, wherein the array is preferably comprised of at least three such fasteners 748, 749 in a group, and wherein the array is comprised of at least two such groups of fasteners 748, 749, with one group of discrete user operable fasteners 748, 749 located on a front of foundation bag 702 and another group of discrete user operable fasteners 748, 749 located on a rear of foundation bag 702.

As also shown in FIG. 9B, permanently attached outer flap 708 may have any geometric shape, such as for example, a trapezoidal shape extending along trapezoidal edge 708[1]. This trapezoidal shape is similar to the trapezoidal shape of flap 108 shown in FIGS. 6A and 6B. In this version, there is no inner skirt, (such as inner skirt 116 shown in FIGS. 6B, 6C, 6F and 6G, or inner skirt 216 shown in FIGS. 7A and 7B, just outer flap 708, which is permanently connected to the middle portion of the front and rear panels of foundation bag 702 at flap joinery edge 708[1], and which has the inner fasteners 748 joinable with further reciprocating fasteners 749.

Figure 10A:
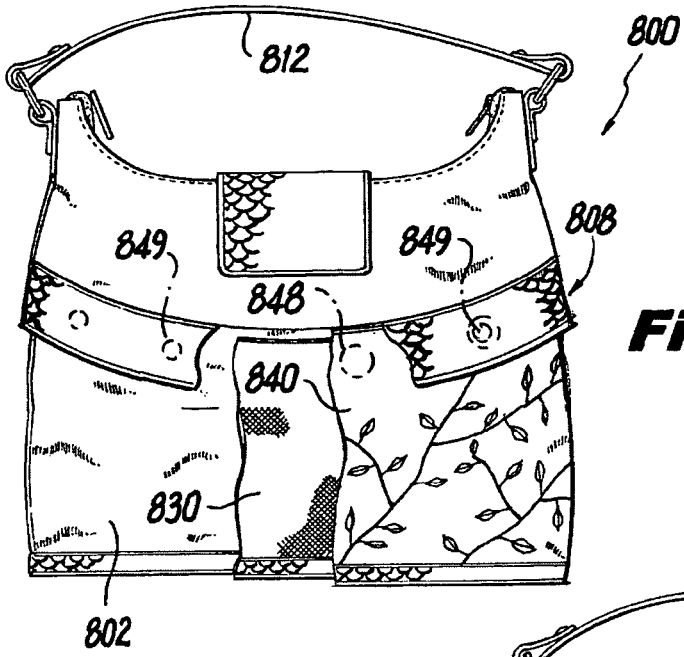
FIG. 10A is a front perspective view of a further alternate embodiment for handbag system showing a curved outer flap attached to the foundation bag wall, with a joinery edge at the upper mid region thereof covering a curved interface applied to multiple stackable curved slip covers, including an array of a plurality of user operable fasteners; wherein the slip covers may be reversible and/or nonreversible.

FIG. 10A shows an example of hobo style handbag system 800 with handle 812 and foundation bag 802 having outer flap 808 with a curved demarcation edge, wherein the curved outer flap 808 contains a curved array of discrete user operable fasteners 848, such as magnets, snaps, buckles, buttons, each having engageable reciprocating parts etc., 849, which attach curved outer slip cover 840 to foundation bag 802. When more than one outer slip cover is applied, optional intermediary cover 830 is nested and is held in place between foundation bag 802 and outermost cover 840, which is attached to foundation bag 802. This optional array may preferably be comprised of an extended arrangement of a plurality of spaced apart fasteners 848, 849, wherein the array is preferably comprised of at least three such fasteners 848, 849 in a group, and wherein the array is comprised of at least two such groups of fasteners 848, 849, with one group of discrete user operable fasteners 848, 849 located on a front of foundation bag 802 and another group of discrete user operable fasteners 848, 849 located on a rear of foundation bag 802.

Figure 10B:
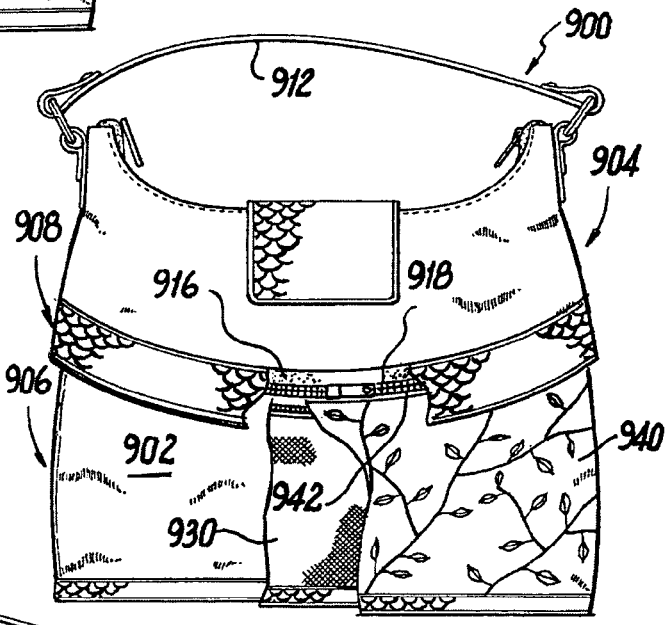
FIG. 10B is a front perspective view showing a handbag system with a curved outer flap where a joinery edge is located on the upper mid region of the foundation bag wall shown in partial cutaway, exposing a curved slide and pull half portion, of a curved zipper, located under the outer flap and engaged with a curved post portion, of a curved zipper, located on the outermost slip cover, with optional inner curved shaped upper regions of slip covers that are located therebetween.

In FIG. 10B, an alternate embodiment for handbag system 900 showing a curved outer flap and curved inner skirt using a curved dual post zipper, such as disclosed in U.S. Pat. No. 6,244,484 of Farrell. Handle 912 is connected to upper portion 904 of foundation bag 902. Foundation bag 902 is covered by at least one optional intermediary slip cover 930 and outer slip cover 940, wherein curved zipper slide and pull half portion 918 is located on lower peripheral edge of inner skirt. It is further noted that the outer slip covers may be one or more slip covers 930 and/or 940, and may be optionally reversible, using slide and pull half portion 918 engageable with dual post half portion 942 of a curved dual post zipper, located on a lower peripheral edge of inner skirt 916. Therefore, it is noted that optionally reversible curved-edged covers 930 or 940 must use dual post curved zippers.

Figure 10C:
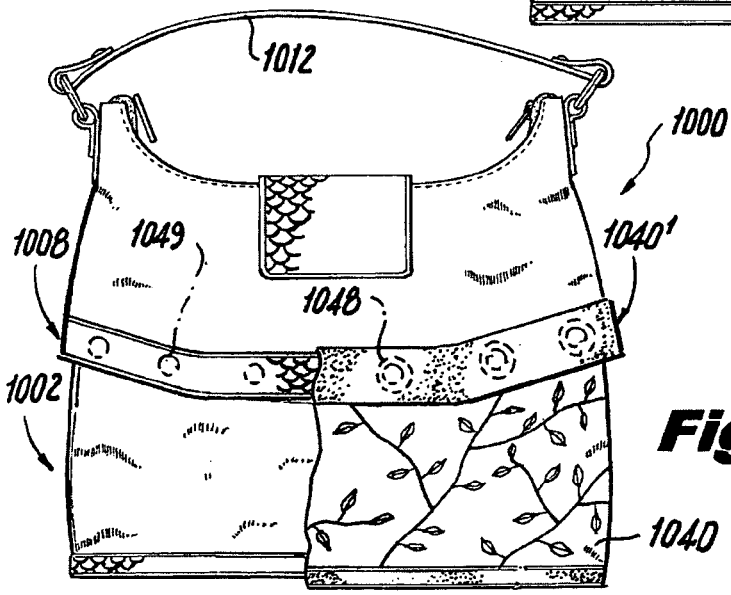
FIG. 10C is a front perspective view of a further alternate embodiment for a handbag system, showing a foundation bag having an outer flap and an outer slip cover having a faux flap mask covering the outer flap of the foundation bag.

Likewise in FIG. 10C, the connection interface of handbag system 1000 includes a non-linear array of discrete user operable fasteners such as sewn in magnets 1048 and metal plates 1049 hidden under outer flap 1008. This optional array may preferably be comprised of an extended arrangement of a plurality of spaced apart fasteners 1048, 1049, wherein the array is preferably comprised of at least three such fasteners 1048, 1049 in a group, and wherein the array is comprised of at least two such groups of fasteners 1048, 1049, with one group of discrete user operable fasteners 1048, 1049 located on a front of foundation bag 1002 and another group of discrete user operable fasteners 1048, 1049 located on a rear of foundation bag 1002.

Furthermore, as also shown in FIG. 10C, it is further noted that outer slip cover 1040 covering foundation bag 1002 may have faux outer flap mask 10401 covering outer flap 1008.

Figure 11A:
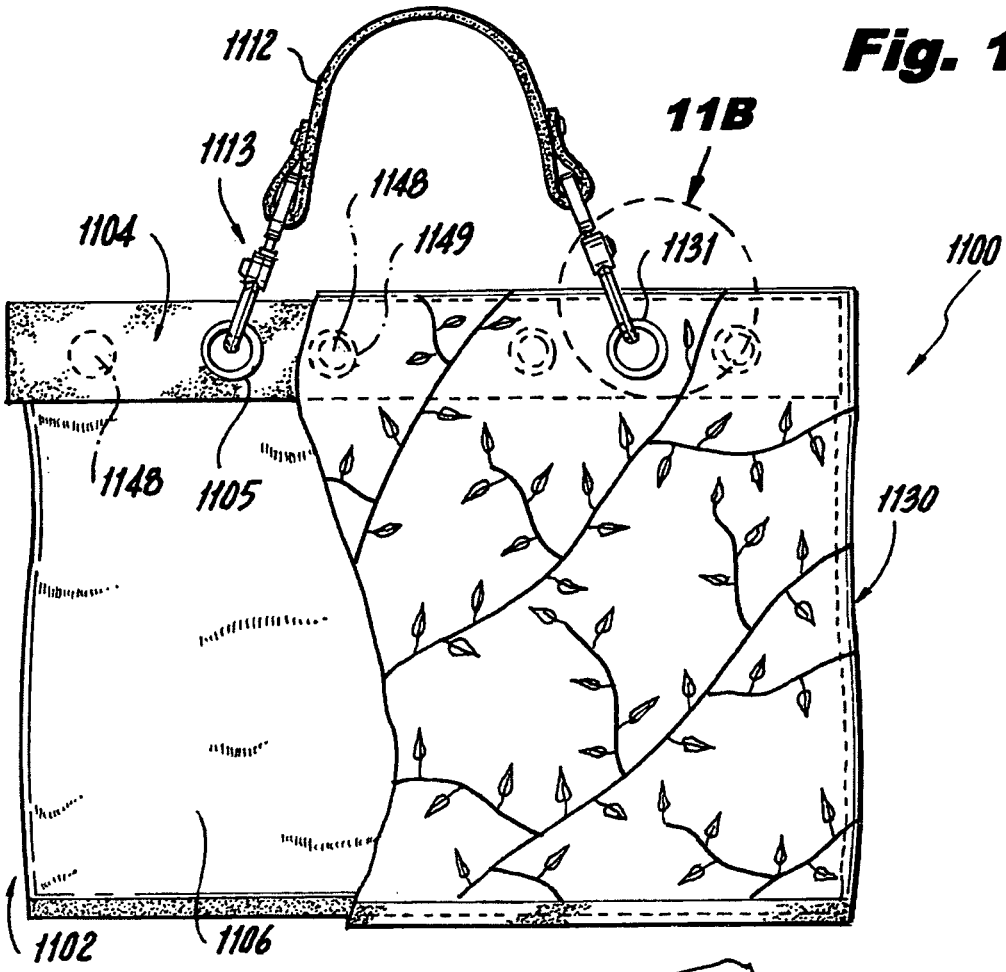
FIG. 11A is a front elevational view of a tote style bag with interchangeable handles, wherein the outer slip cover is connected to the foundation bag by connections to the handle and optional inner discrete interface connections.

In FIG. 11A, the handbag system 1100 may include foundation bag 1102 having lower portion 1106 and upper portion 1104, wherein both respective upper and lower portions 1104 and 1106, are covered by outer slip cover 1130, but wherein the entire foundation bag is covered by outer slip cover 1130. In that case, the attachment for outer slip cover 1130 is via a connection of fasteners, such as swivel snaps 1113, located on handle strap 1112 of foundation bag 1102, connected through grommets 1105 and 1131 on outer slip cover 1130 and grommets 1105 and 1131 on foundation bag upper portion 1104 of handbag system 1100. Further fasteners may optionally include an array of hidden discrete user operable fasteners such as disks and magnets 1148 and 1149 and other fasteners known to one in the industry. Also, it can be appreciated that more than one slip cover may be stacked, which allows outer slip cover 1130 to stay snug to the upper portion 1104 of foundation bag 1102.

Figure 11B:
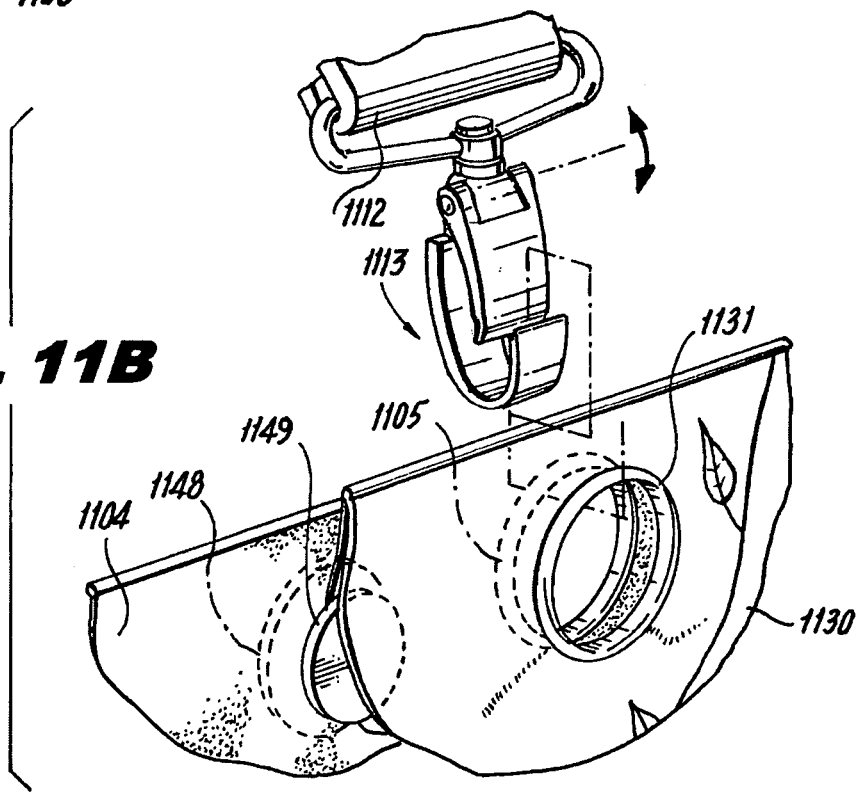
FIG. 11B is a close up view of two examples of the connectors shown in FIG. 11A, including a handle connector and a discrete concealed sewn in magnetic fastener connector.

FIG. 11B shows swivel snap 1113 in exploded view prior to insertion through grommet 1131, which has a decorative outer edge, providing an aperture through cover 1130 and through further grommet 1105 providing an aperture through upper portion 1104 of foundation bag 1102, and wherein the optionally attached discrete concealed sewn in magnetic fasteners 1148 and 1149 are shown beneath outer slip cover 1130 and are attached to upper portion 1104 of foundation bag 1102. Therefore swivel snap 1113 of handle 1112 extends through both slip cover 1130 and foundation bag 1102 via respective grommets 1131 and 1105. The configuration in FIG. 11B allows for changing of handle 1112 for another handle 1112, whereby handles have other respective swivel snaps 1113 for engaging grommets 1131 and 1105 respectively. It is appreciated that arrays of other types of fasteners other than swivel snaps such as buckles, toggles, snap hooks, clips and spring hooks may be used for engaging grommets or other apertures to connect slip covers to foundation bag 1102. This optional array may preferably be comprised of an extended arrangement of a plurality of spaced apart fasteners 1148, 1149, wherein the array is preferably comprised of at least three such fasteners 1148, 1149 in a group, and wherein the array is comprised of at least two such groups of fasteners 1148, 1149, with one group of discrete user operable fasteners 1148, 1149 located on a front of foundation bag 1102 and another group of discrete user operable fasteners 1148, 1149 located on a rear of foundation bag 1102.

Figure 12A:
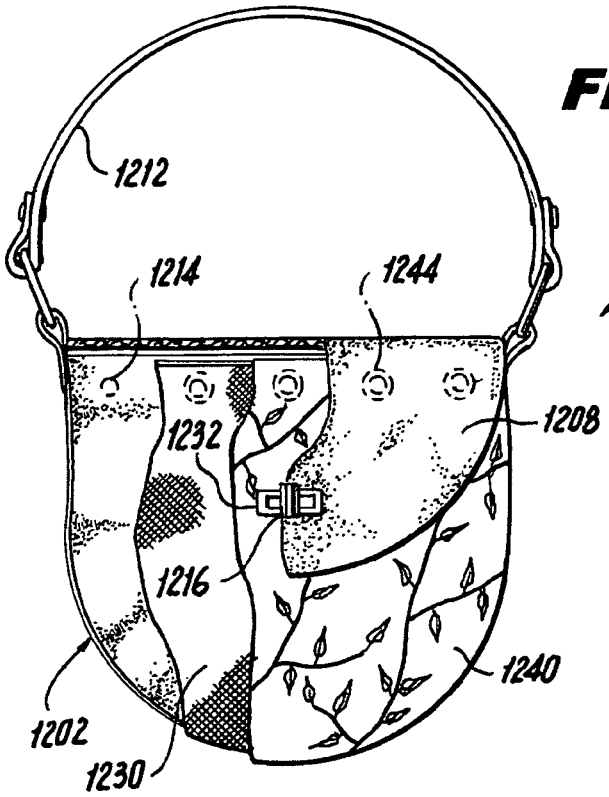
FIG. 12A is a front perspective view, shown in partial cutaway, of an alternate embodiment for a messenger style handbag system, showing one or more slip covers attached to a foundation bag via multiple types of fastening structures, wherein the fastening structures used therein are triple plate turn locks and a plurality of linear placed discrete magnetic fasteners.
Figure 12B:
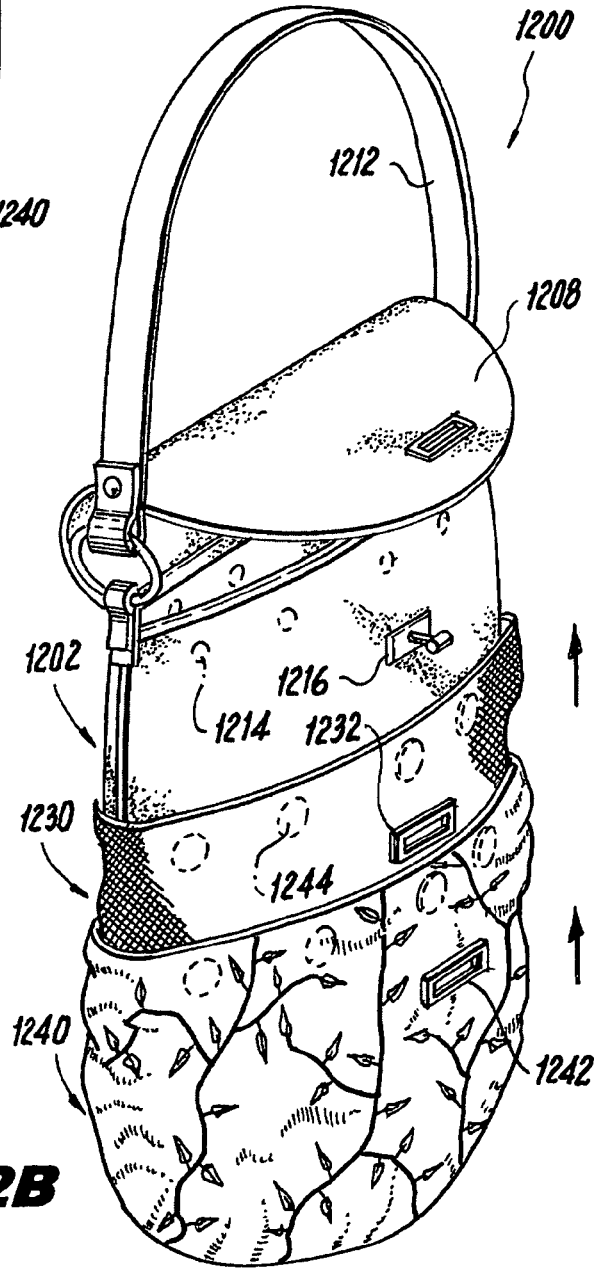
FIG. 12B is an exploded perspective view of FIG. 12A, showing the connections of the sewn in magnets along the upper circumference of the foundation bag and the reciprocating magnets sewn in the slip covers. The protrusion part of the turn lock attached to the foundation bag wall receives the plates first from the intermediary cover, next from the outer most covers and lastly from the foundation bag top flap, which closes the top opening of the foundation bag.

Furthermore, as shown in messenger-type handbag system 1200 shown in FIGS. 12A and 12B, it is noted that in order to secure one or more outer slip covers 1230 and 1240, and to close top flap 1208, turn lock 1216 may be provided for handbag system 1200. (Turn lock 1216 is similar to turn lock 309 of FIGS. 8A and 8B). Turn lock 1216 is progressively exposed through frame opening apertures 1232 of intermediary slip cover 1230 and/or further aperture opening 1242 of outermost slip cover 1240. Handle 1212 is attached to upper region of foundation bag 1202 and the one or more slip covers are optionally held by either a zipper (not shown) and/or by an optional array of a plurality of discrete user operable fasteners with mating attachments such as sewn in magnet fastener 1244 connected to reciprocal magnet fasteners 1214 of foundation bag 1202. This optional array may preferably be comprised of an extended arrangement of a plurality of spaced apart fasteners 1214, 1244, wherein the array is preferably comprised of at least three such fasteners 1214, 1244 in a group, and wherein the array is comprised of at least two such groups of fasteners 1214, 1244, with one group of discrete user operable fasteners 1214, 1244 located on a front of foundation bag 1202 and another group of discrete user operable fasteners 1214, 1244 located on a rear of foundation bag 1202.

Figure 13A:
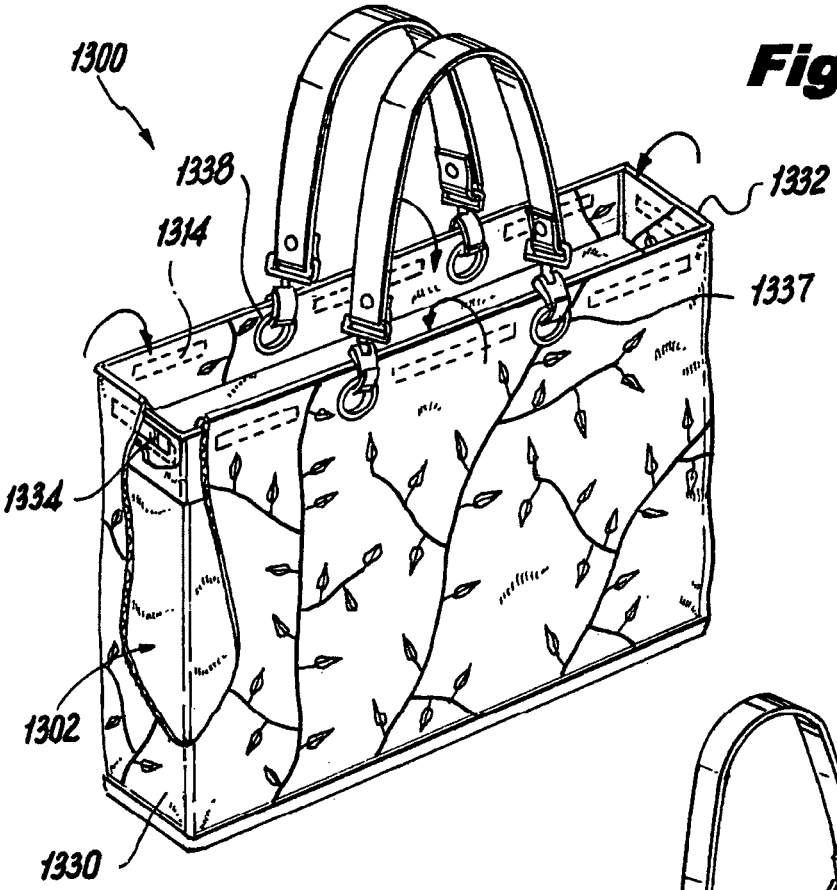
FIGS. 13A and 13B are further examples of a tote style bag with a foundation bag and a slip cover, wherein the outer slip cover is connected inside the foundation bag to an inner surface thereof, wherein FIG. 13B uses the handbag handle and magnetic fasteners to contain the cover, as follows.

The aforementioned versions of the handbag systems described in FIGS. 6A through 12B show the one or more slip covers connected through an outer portion along the any outer region surface of the foundation bag, or of intermediary slip covers. However, in certain circumstances, such as tote bag 1300 shown in FIGS. 13A and 13B, outer slip cover 1330 may be connected by lapping over the outer edge of foundation bag 1302, and thereby connecting to the inside of foundation bag 1302 by virtue of an array of fasteners, such as magnet 1314 and plate 1334 or other reciprocating elements, such as handle connectors 1336, which protrude respectively through grommets 1304 of foundation bag 1302, grommets 1337 of outer slip cover 1330 and grommets 1338 of foldover flaps 1336*a*, 1336*b*, 1336*c* and 1336*d*. To facilitate this construction, end flaps 1336*a* and 1336*b* as well as side flaps 1336*c* and 1336*d* are attached to the top edge of slip cover 1330 at welt 1332.

Figure 13B:
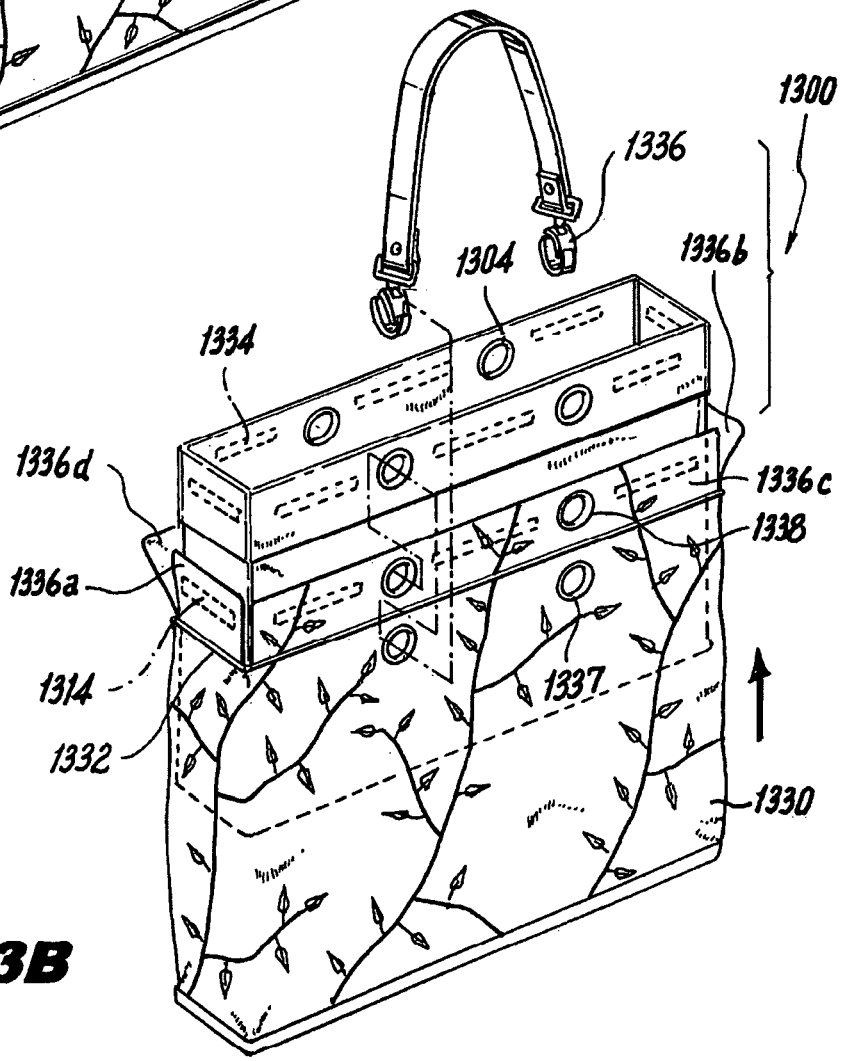

FIG. 13B is an exploded view showing the handbag system 1300 with various connectors 1314 connected to connector 1334 and wherein inner grommets 1338 are provided on slip cover 1330, and which inner grommets 1338 are in positional register with outer grommets 1337 of slip cover 1330 and with grommets 1304 of foundation bag 1302, when flaps 1336*a*, 1336*b*, 1336*c* and 1336*d* are folded over the edge of foundation bag 1302 and connected to reciprocating sides of respective fasteners and where swivel snaps are shown in an exploded view in FIG. 13B prior to insertion through grommets.

It is appreciated that other types of fasteners other than swivel snaps such as buckles, toggles, snap hooks, clips and spring hooks may be used for engaging grommets or other apertures to connect covers to foundation bag.

While the drawings are illustrative of various examples, it is noted that the trapezoidal flaps or curved flaps or straight flaps are just some example of flaps covering the connection interface between one or more outer slip covers which may or may not be reversible, which cover a portion or all of the foundation bag which without any outer slip covers is a fully functional handbag by itself. Therefore, the present invention includes a system for interchangeably changing the decorative aspects of a handbag by providing an optional inner skirt which contains attachments of arrays of various fastening systems which engage one or more slip covers in continuous linear, non-linear and/or curved arrays of a plurality of user operable fasteners. The slip covers may or may not be reversible and may connect to a foundation bag along any region thereof. The outer slip covers or optional intermediary slip covers may each have one or more apertures for exposing a surface portion of the foundation bag or an intermediary slip cover through the apertures of the slip covers.

Where a permanently affixed outer flap of the foundation bag is provided over a zipper, such as a dual post zipper for reversible and/or interchangeable and/or stackable slip covers or such as a regular zipper for non-reversible interchangeable and/or stackable slip covers, then in such case, the flap itself may be further liftable to expose an inner skirt having a connection interface at an outer, distal end region or edge, to allow better manual access therein and allow for the use of horizontal zippers in instances where the demarcation edge of flap is other than a horizontal shape, i.e. trapezoid, curve, zigzag, wavy, angular, etc.

Furthermore, the outer slip covers, when provided as a plurality of outer slip covers, may be nested respectively and multiply stacked, wherein the inner stacked intermediate outer slip covers are nested between the foundation bag and the outermost outer slip cover, which attaches at an upper end, or upper portion thereof, to the foundation bag by a single connection interface, such as a dual post or conventional zipper under a linear flap or by an array of discrete user operable fasteners such as buttons, snaps, clasps, magnets, turn locks, sewn in fasteners or any other fasteners such as known to those skilled in the art.

While the foregoing is directed to embodiments of the present invention, other and further embodiments of the invention may be devised without departing from the basic scope thereof, and the scope thereof is determined by the claims that follow. Illustratively, the invention has been described as having a pull and slide zipper portion on the foundation bag, and either a single post or dual post zipper portion on the slipcover. However, those illustrations are not intended to limit the scope of the invention in any way. For example, the pull and slide zipper portion can be located on the slipcover and either the single post or dual post zipper portion can be located on the foundation bag.

It is appreciated that many different types (e.g., sizes and styles) of foundation bag and covers can be used in accordance with the invention. While the foregoing is directed to embodiments of the present invention, other and further embodiments of the invention may be devised without departing from the basic scope thereof, and the scope thereof is determined by the claims that follow.

We claim:

1. A handbag system, comprising:

a foundation handbag having front, rear and bottom regions forming a container having an inner surface and an outer surface and which is open at a top end for receiving and allowing extraction of articles;

an inner skirt extending down from the top end to a first connecting portion of a connecting means and covering contiguously an upper portion of the front and rear regions of the outer surface of the foundation handbag;

an outer flap extending down from the top end that is adapted to removably cover the inner skirt and said connecting means; and at least one reversible slip cover comprised of front, rear and bottom regions forming a container open at a top end at which a second connecting portion of said connecting means adapted for mating to said first connecting portion is attached;

wherein said at least one reversible slip cover is detachably connected to said inner skirt to contiguously cover a lower portion of the front and rear regions, and the bottom region of said outer surface of said foundation handbag; and wherein said inner skirt is dimensioned such that at least one other slip cover is retainable between said at least one reversible slip cover and said foundation handbag when said at least one reversible slip cover and said foundation handbag are connected via the connecting means.

2. The handbag system as in claim 1, wherein said connecting means comprises a zipper.

3. The handbag system as in claim 1, wherein said connecting means comprises a dual post zipper.

4. The handbag system as in claim 1, wherein said connecting means comprises a substantially straight interface between a lower end of the inner skirt and the top end of said at least one reversible slip cover.

5. The handbag system of claim 1 further comprising:

an inner surface of said at least one reversible slip cover contiguously covering circumferentially in a horizontal side to side plane said outer surface of said foundation handbag but less than all of said outer surface of said foundation handbag extending in a top to bottom vertical plane.

6. A handbag system, comprising:

a foundation handbag having an inner storage compartment and an outer surface;

wherein said foundation handbag has interior, front, rear and bottom regions connected by at least one edge to form a container open at a top end thereof;

at least one slip cover, said at least one slip cover having interior, front, rear and bottom regions connected by at least one edge to form a container open at a top end thereof, wherein a continuous inner surface of said at least one slip cover continuously covers at least a continuous portion of said outer surface of said foundation handbag, wherein said foundation handbag and said at least one slip cover have a common connection interface therebetween; and an outer flap affixed to and extending outwardly from said outer surface of said foundation bag, said outer flap covering the common connection interface between said at least one slip cover and said foundation bag, wherein said outer flap further includes a vented portion.

7. An interchangeable handbag system, comprising:

a discrete foundation handbag having front, rear and bottom regions forming a container open at a top end thereof for receiving and extracting articles, and having an inner container surface and an outer decorative surface;

at least one outer slip cover having front, rear and bottom regions forming a container open at a top end thereof for receiving said discrete foundation handbag and continuously covering a circumferential continuous portion of said outer decorative surface including the bottom region, and a portion of the front and rear regions extending from the bottom region to connect to said discrete foundation handbag;

a fastener for fastening the at least one outer slip cover to said discrete foundation handbag; and a circumferential inner skirt covering a portion of and attached to said discrete foundation handbag and including a fastener portion engageable with a reciprocating fastener portion of said fastener attached to said at least one outer slip cover, wherein said inner skirt is dimensioned such that at least one other slip cover is retainable between said at least one outer slip cover and said discrete foundation handbag when said at least one outer slip cover and said foundation handbag are fastened via the fastener portions;

a decorative circumferential flap permanently attached to said discrete foundation handbag at the top end to conceal said circumferential inner skirt and a portion of said decorative surface extending down to said fastener.

8. An interchangeable handbag system, comprising:

a discrete foundation handbag having front, rear and bottom regions arranged in a form of a hollow container open at a top end thereof, the hollow container including an inner storage containing surface and an outer decorative surface;

at least one reversible outer slip cover having front, rear and bottom regions arranged in a form of a hollow container open at a top end thereof for receiving said discrete foundation handbag and continuously covering at least a circumferential continuous portion of said outer decorative surface of said discrete foundation handbag;

a circumferential inner skirt covering a portion of and attached to said discrete foundation handbag;

wherein said circumferential inner skirt and said at least one reversible outer slip cover have a common connection interface therebetween, said common connection interface comprising a handbag-side fastener portion engageable with a reciprocating fastener portion attached to the top end of said at least one reversible outer slip cover, and wherein said inner skirt is dimensioned such that at least one other slip cover is retainable between said at least one reversible outer slip cover and said foundation handbag when said at least one reversible outer slip cover and said circumferential inner skirt are fastened via the common connection interface; and a decorative concealing circumferential flap permanently attached to said discrete foundation handbag and extending from said outer decorative surface thereof, wherein said circumferential inner skirt is disposed beneath said circumferential flap.

9. The handbag system of claim 8 further comprising:

an inner surface of said at least one reversible outer slip cover contiguously covering circumferentially in a horizontal side to side plane said outer decorative surface of said discrete foundation handbag but less than all of said outer decorative surface of said discrete foundation handbag extending in a top to bottom vertical plane.

* * * * *